US010006288B2

(12) United States Patent
Choi

(10) Patent No.: US 10,006,288 B2
(45) Date of Patent: Jun. 26, 2018

(54) AXIAL TURBINE

(71) Applicant: Hyuk Sun Choi, Gwangju (KR)

(72) Inventor: Hyuk Sun Choi, Gwangju (KR)

( * ) Notice: Subject to any disclaimer, the term of this patent is extended or adjusted under 35 U.S.C. 154(b) by 868 days.

(21) Appl. No.: 14/349,162

(22) PCT Filed: Sep. 27, 2012

(86) PCT No.: PCT/KR2012/007793

§ 371 (c)(1),
(2) Date: Apr. 2, 2014

(87) PCT Pub. No.: WO2013/051818

PCT Pub. Date: Apr. 11, 2013

(65) Prior Publication Data

US 2014/0255180 A1 Sep. 11, 2014

(30) Foreign Application Priority Data

Oct. 4, 2011 (KR) ..... 10-2011-0100782

(51) Int. Cl.

| | |
|---|---|
| ***F02D 1/02*** | (2006.01) |
| ***F01D 1/02*** | (2006.01) |
| ***F01D 1/14*** | (2006.01) |
| ***F01D 1/22*** | (2006.01) |
| ***F01D 1/32*** | (2006.01) |
| ***F01D 1/34*** | (2006.01) |

(52) U.S. Cl.

CPC ..... *F01D 1/026* (2013.01); *F01D 1/14* (2013.01); *F01D 1/22* (2013.01); *F01D 1/32* (2013.01); *F01D 1/34* (2013.01)

(58) Field of Classification Search

CPC ... F01D 1/026; F01D 1/34; F01D 1/14; F01D 1/22; F01D 1/32

USPC ..... 415/199.1; 418/81

See application file for complete search history.

(56) References Cited

U.S. PATENT DOCUMENTS 1,349,487 A * 8/1920 Bennett ..... F01D 1/026 415/175
1,676,806 A * 7/1928 Smalley ..... F01D 1/026 415/103
4,027,995 A * 6/1977 Berry ..... F01D 1/34 415/202

(Continued)

FOREIGN PATENT DOCUMENTS

GB 190913339 A * 1/1910 ..... F01D 1/026
KR 10-2003-0076476 A 9/2003

(Continued)

*Primary Examiner* — Jason T Newton
(74) *Attorney, Agent, or Firm* — Novick, Kim & Lee, PLLC; Jae Youn Kim

(57) ABSTRACT

The present invention relates to an improvement of an axial turbine. Thereto, the present invention includes a submerged turbine 100 in which a fluid is filled in an interior thereof. The present invention also includes a colliding turbine 200 for ejecting a fluid with a high pressure to rotate blades. The structure of the turbine according to the present invention includes a submerged turbine, a colliding turbine, or a combination type turbine (in which a submerged turbine and a colliding turbine are combined). Accordingly, quality and reliability of the product are significantly improved to satisfy the operator.

4 Claims, 26 Drawing Sheets

(56) References Cited

U.S. PATENT DOCUMENTS

| | | | | | |
|---|---|---|---|---|---|
| 4,150,918 | A * | 4/1979 | Theis, Jr. | F01D 1/026 | 415/202 |
| 4,421,454 | A * | 12/1983 | Wosika | F01D 1/34 | 415/117 |
| 5,222,863 | A | 6/1993 | Jones | | |
| 5,768,893 | A * | 6/1998 | Hoshino | F01D 25/10 | 60/682 |
| 6,354,800 | B1 * | 3/2002 | Hays | F01D 1/32 | 415/202 |
| 2011/0164958 | A1 * | 7/2011 | Saitoh | F01D 1/026 | 415/1 |
| 2011/0232285 | A1 * | 9/2011 | Nowi | F01D 1/026 | 60/653 |
| 2011/0311347 | A1 * | 12/2011 | Marsden | F01D 1/026 | 415/1 |
| 2012/0009055 | A1 * | 1/2012 | Kim | F01D 1/22 | 415/80 |

FOREIGN PATENT DOCUMENTS

| | | | | |
|---|---|---|---|---|
| KR | 10-2005-0093002 | A | 9/2005 | |
| KR | 1020070092841 | A1 * | 9/2007 | F02C 6/02 |
| KR | 10-0801717 | B1 | 2/2008 | |
| KR | 10-2010-0105103 | A | 9/2010 | |

* cited by examiner

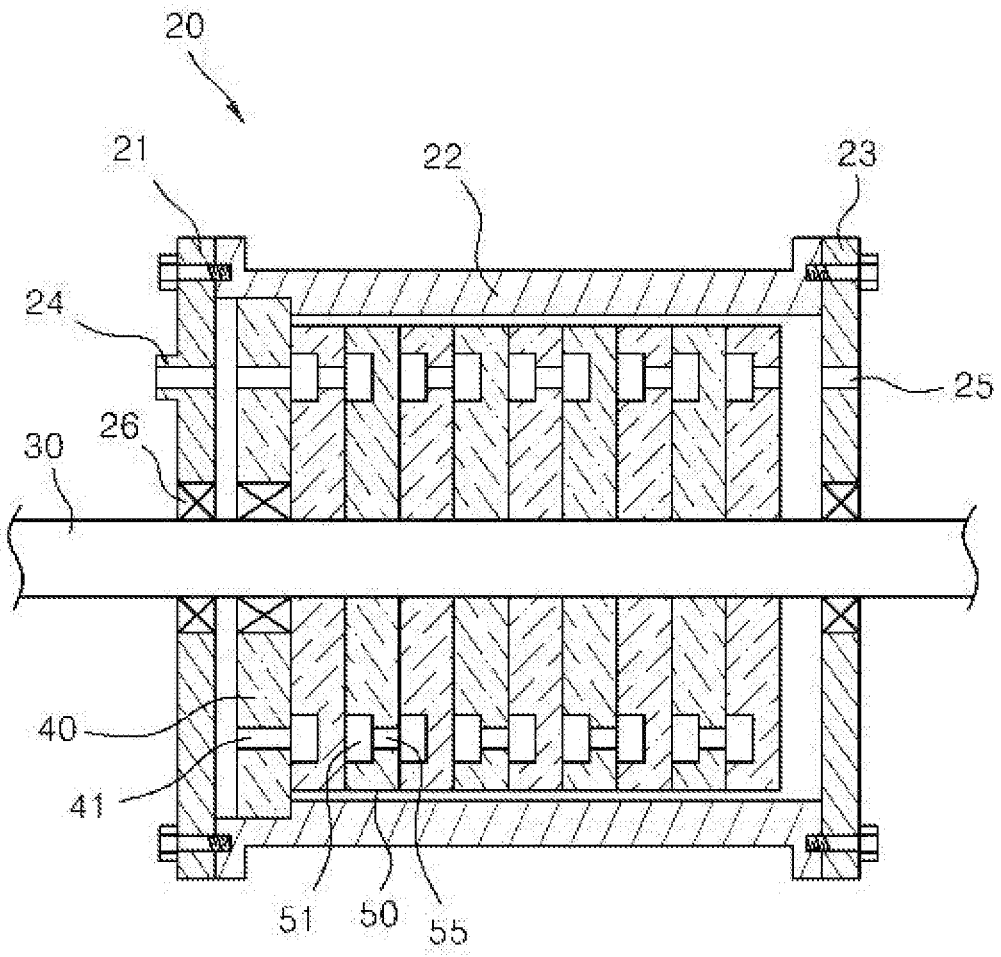
[Fig.1a]
PRIOR ART

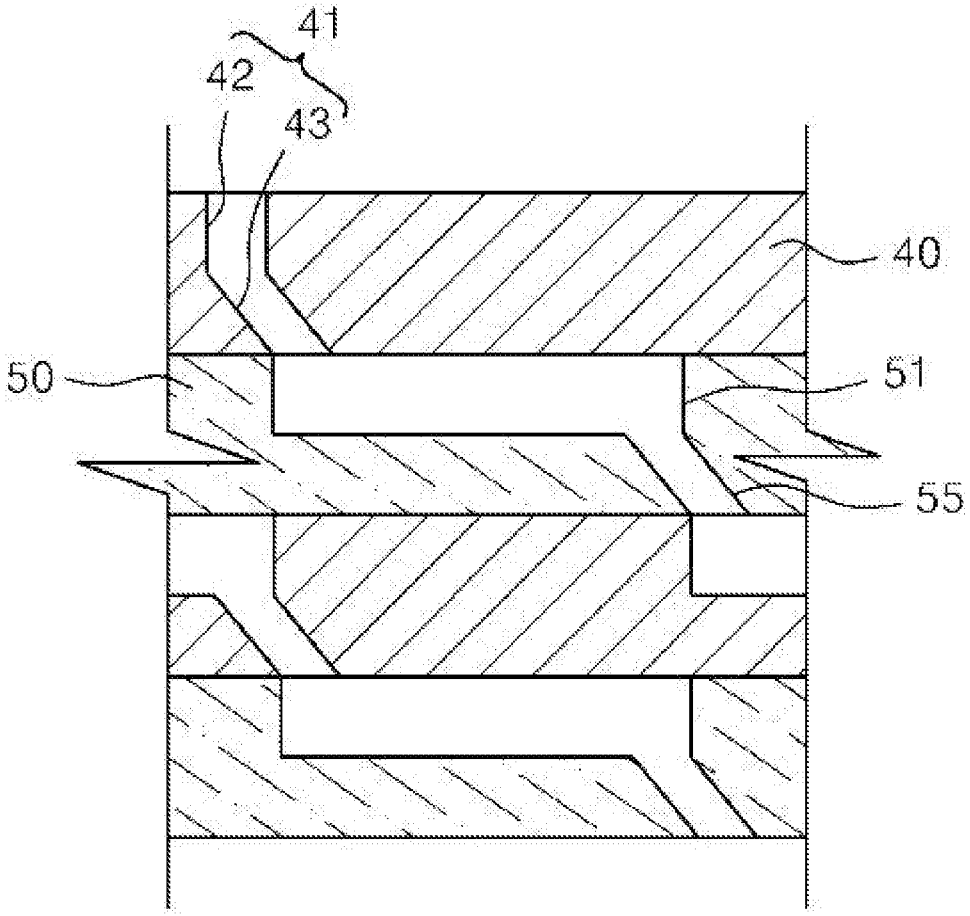
[Fig.1b]
PRIOR ART

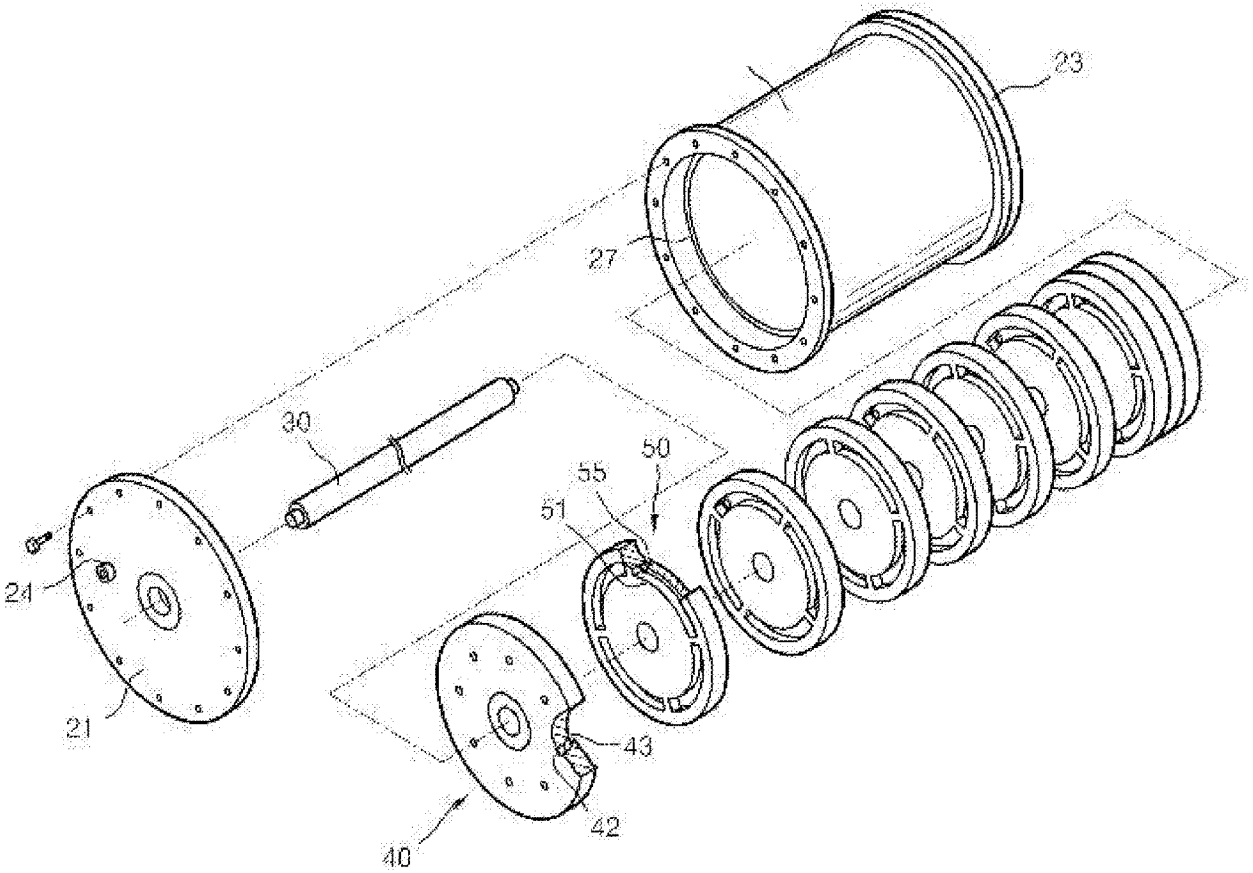
[Fig.1c]
PRIOR ART

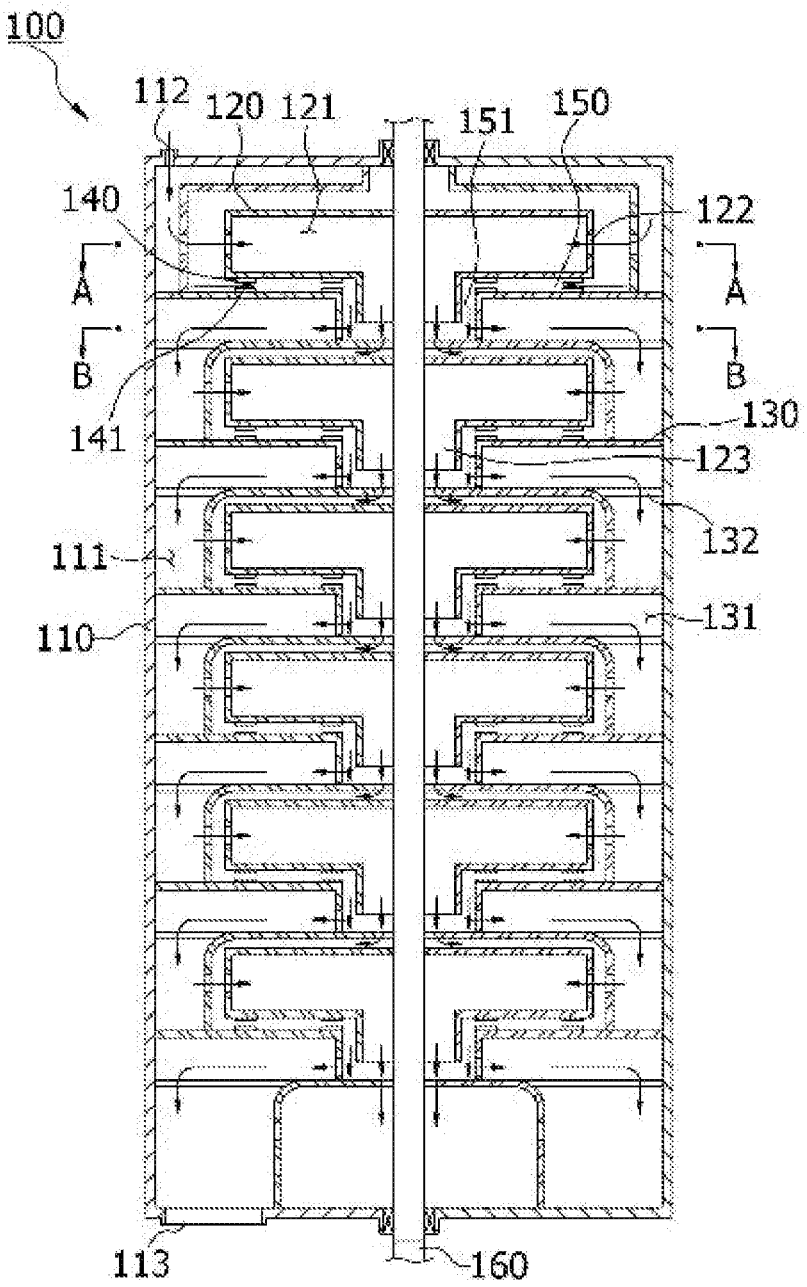
[Fig.2]

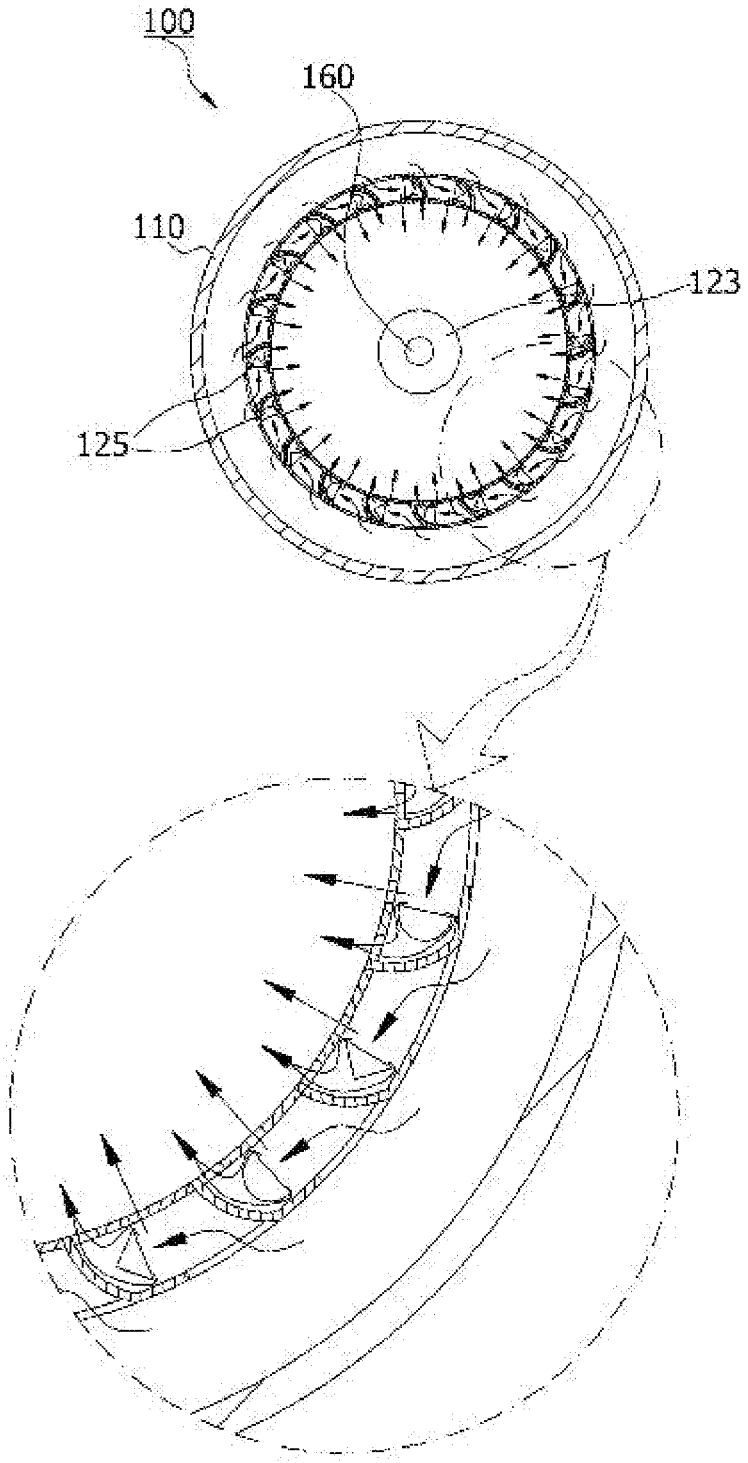
[Fig.3]

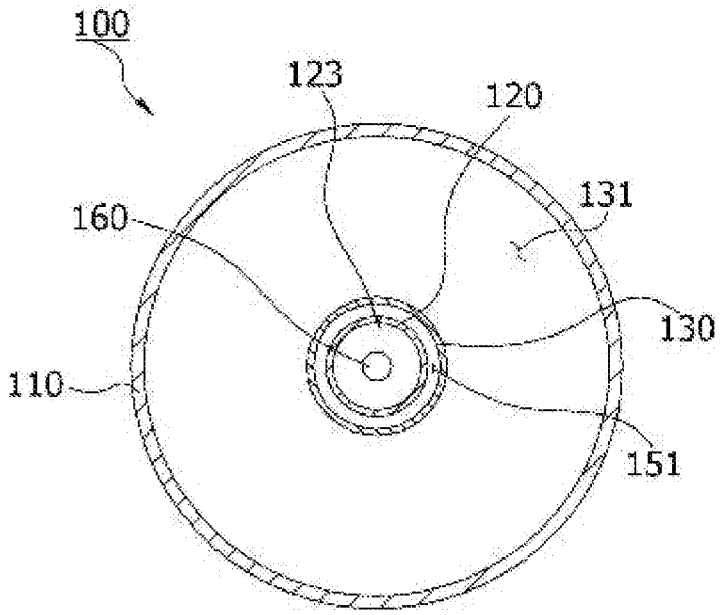
[Fig.4]

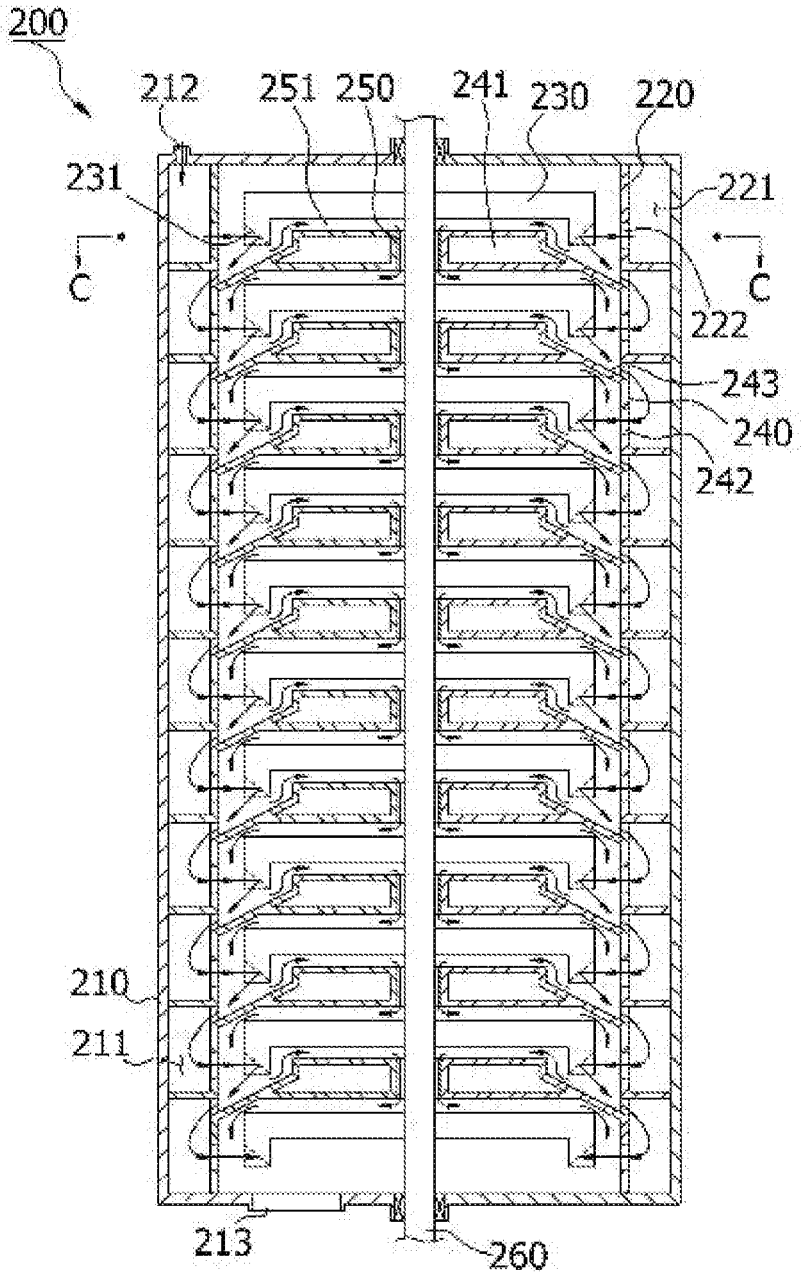
[Fig.5]

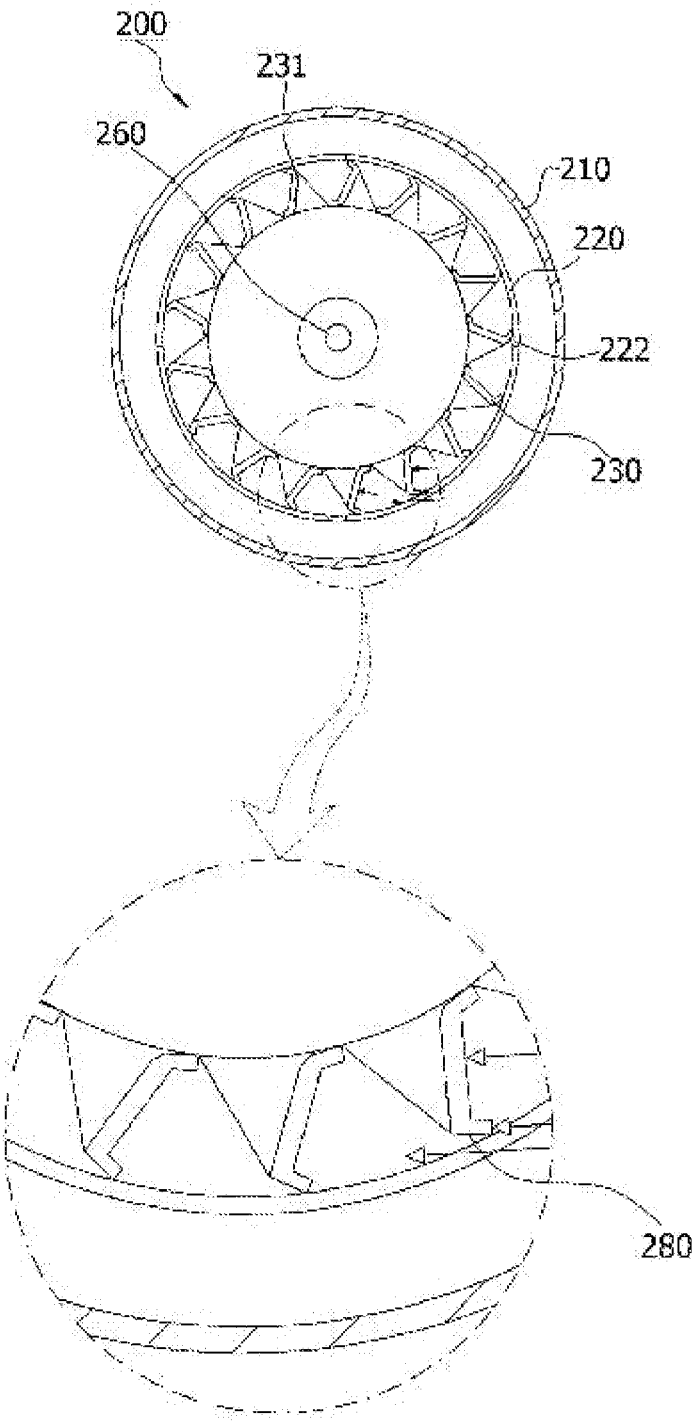
[Fig.6]

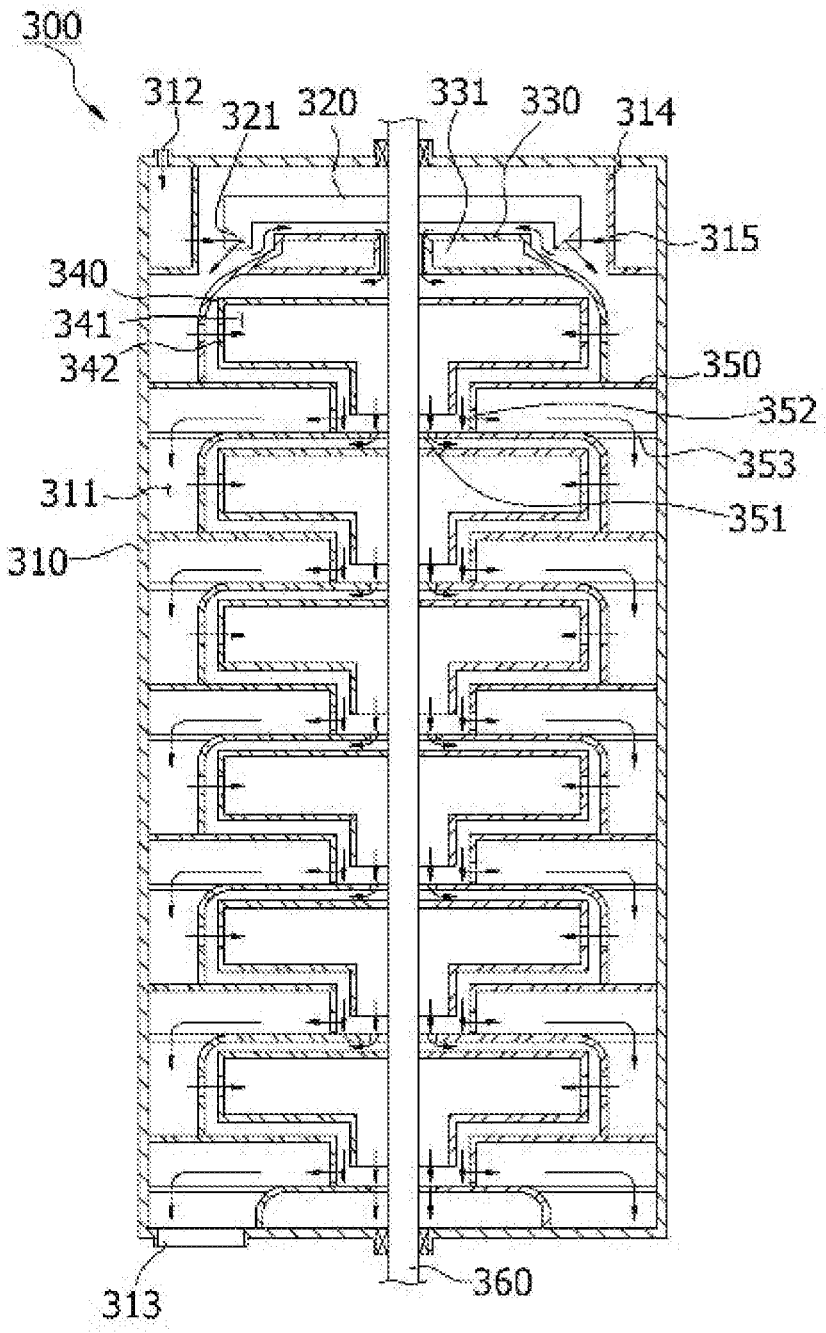
[Fig.7]

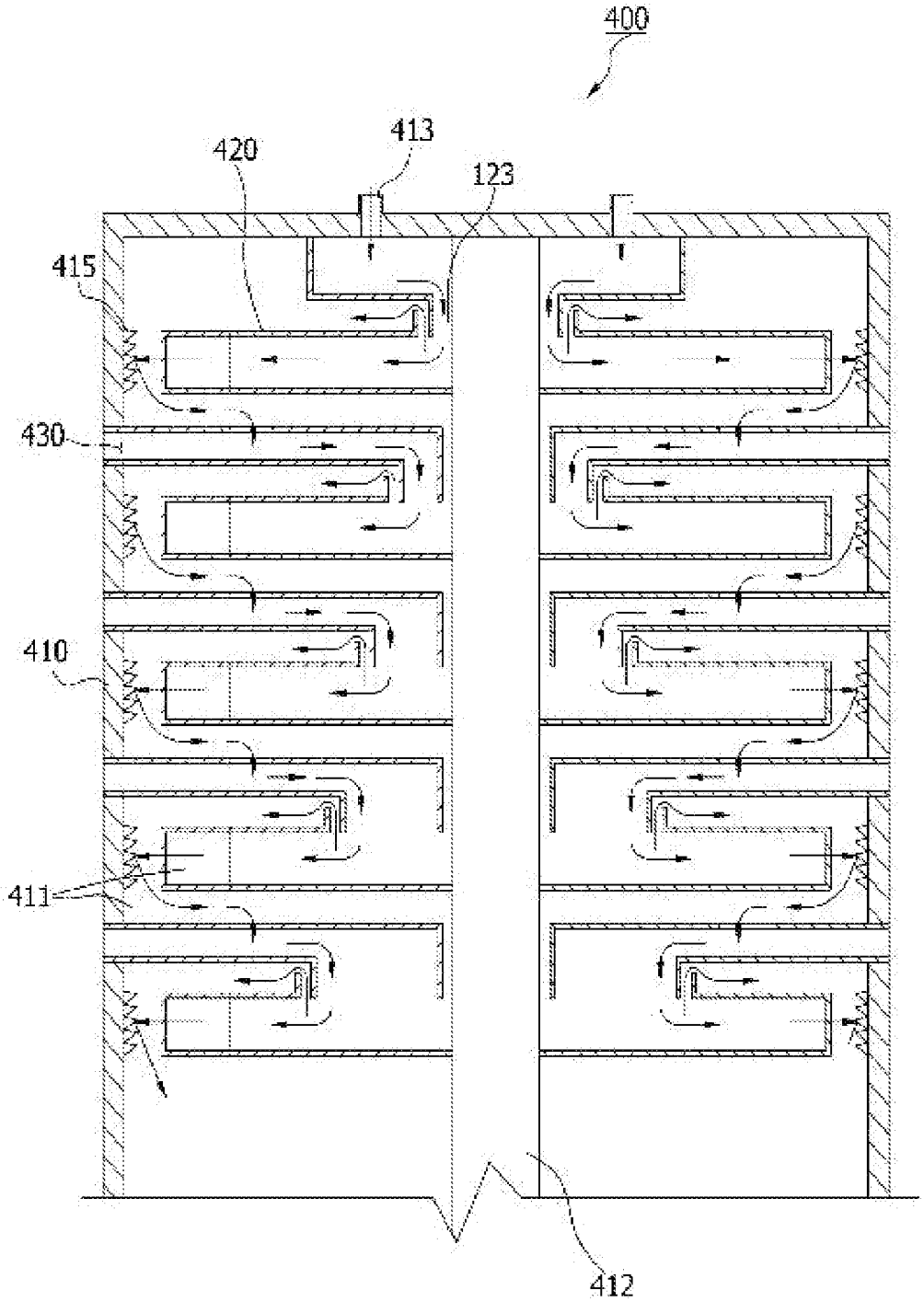
[Fig.8]

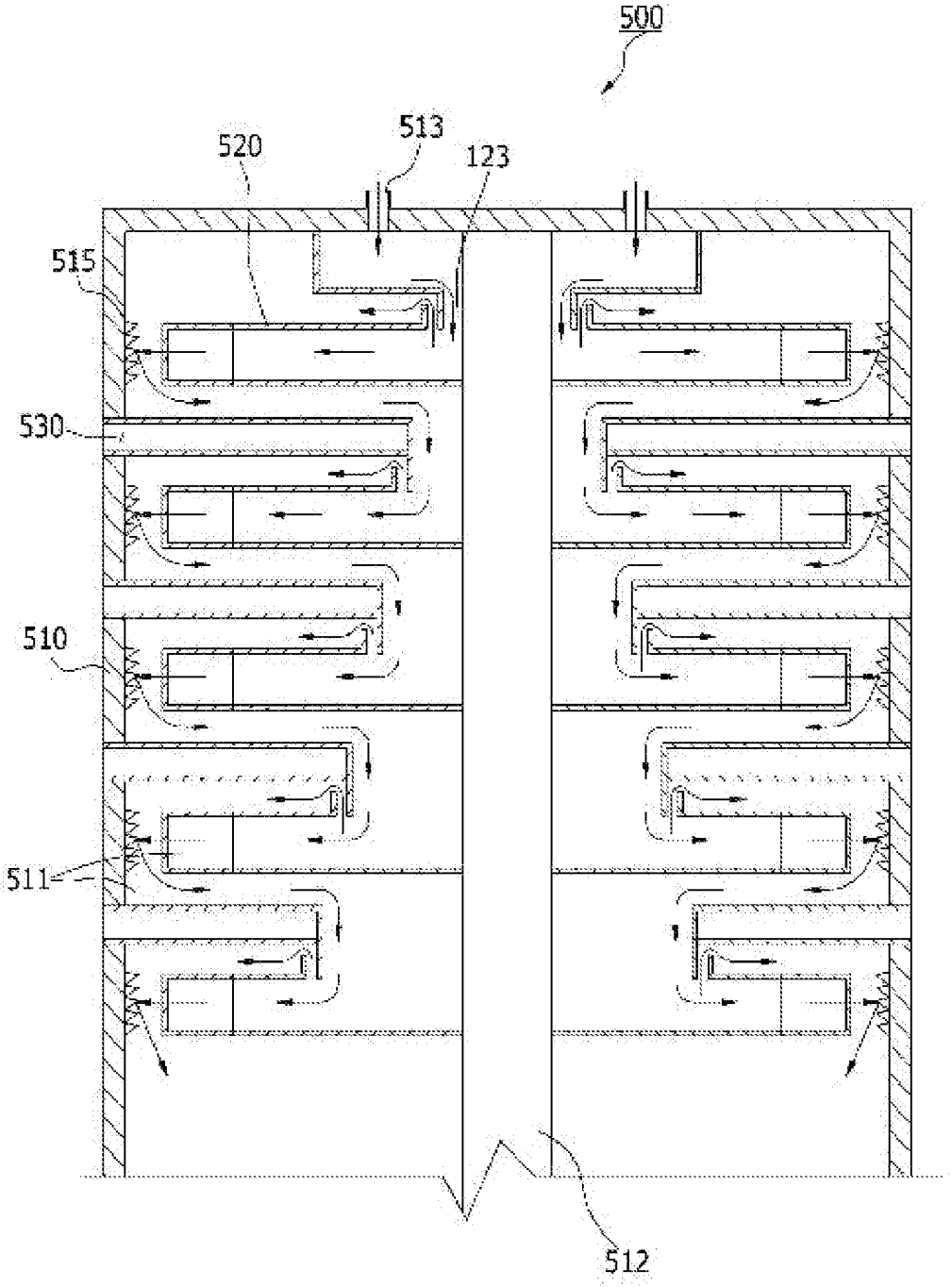
[Fig.9]

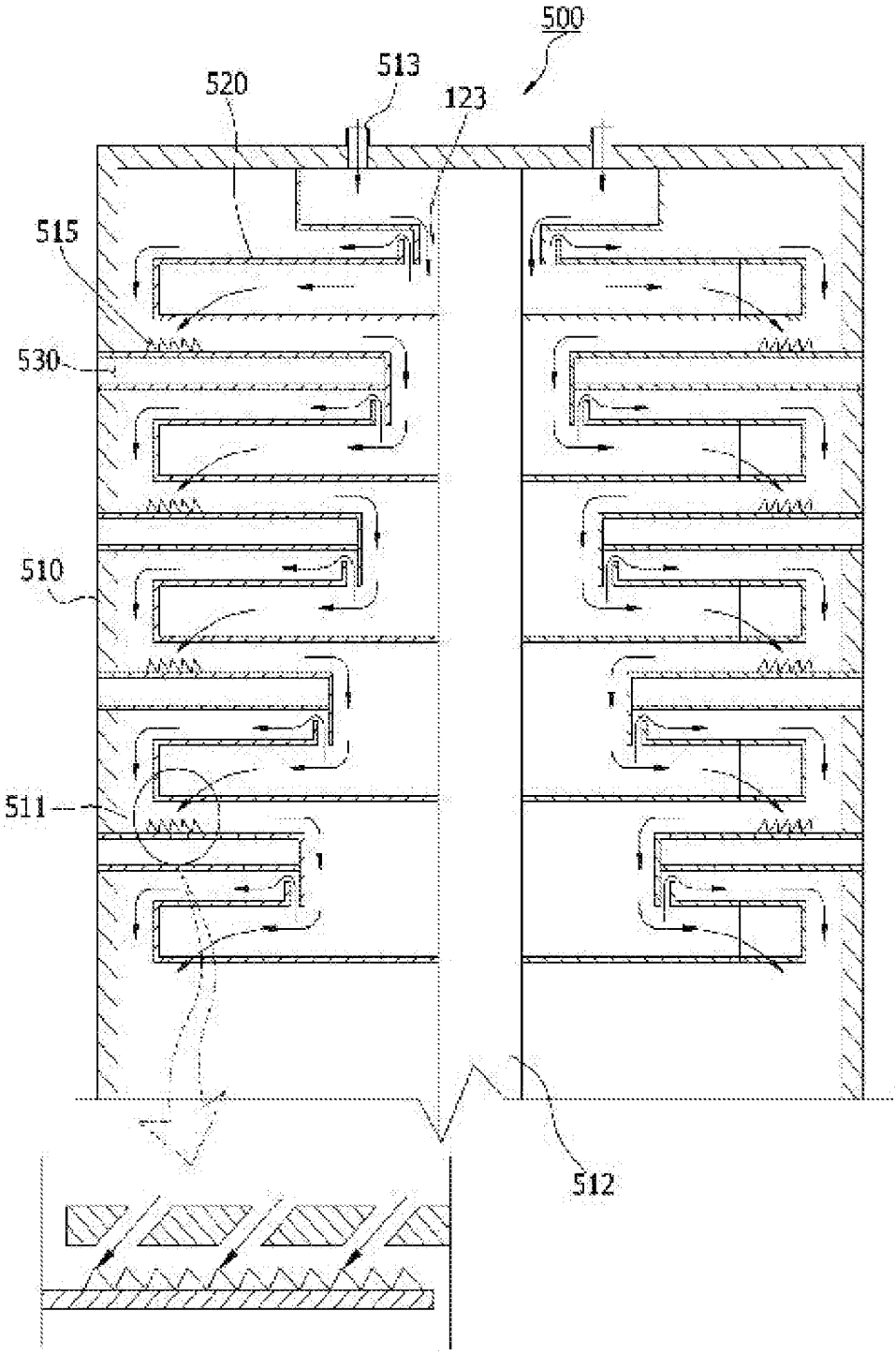
[Fig.10]

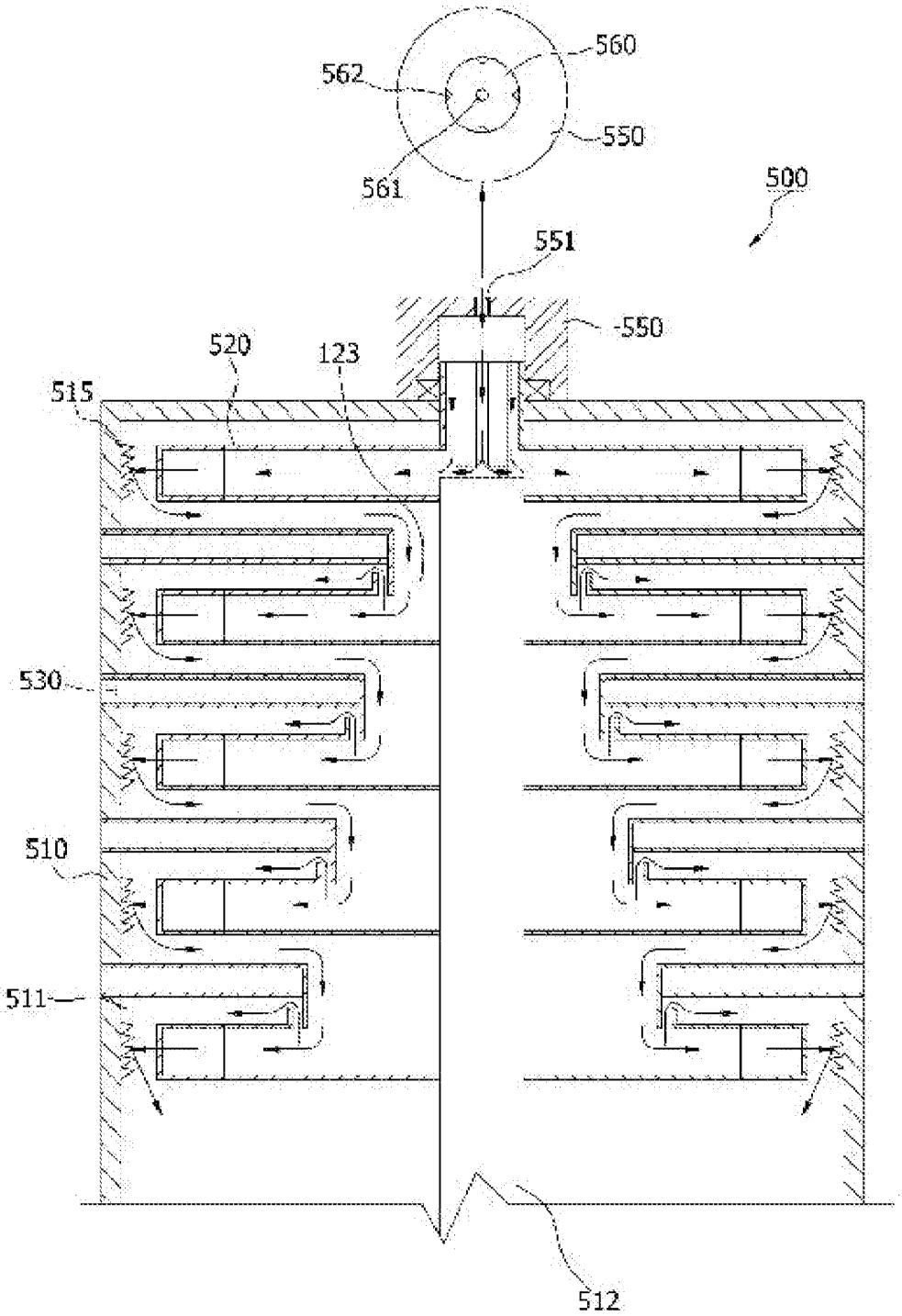
[Fig.11]

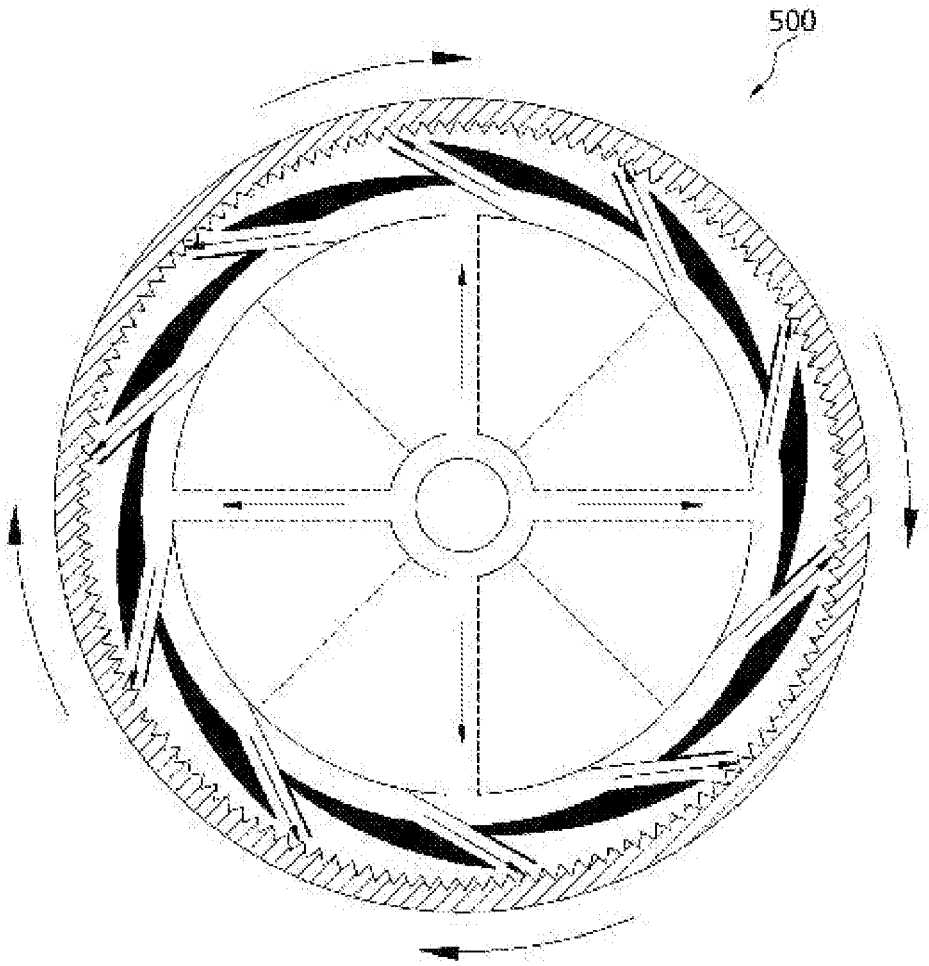
[Fig.12]

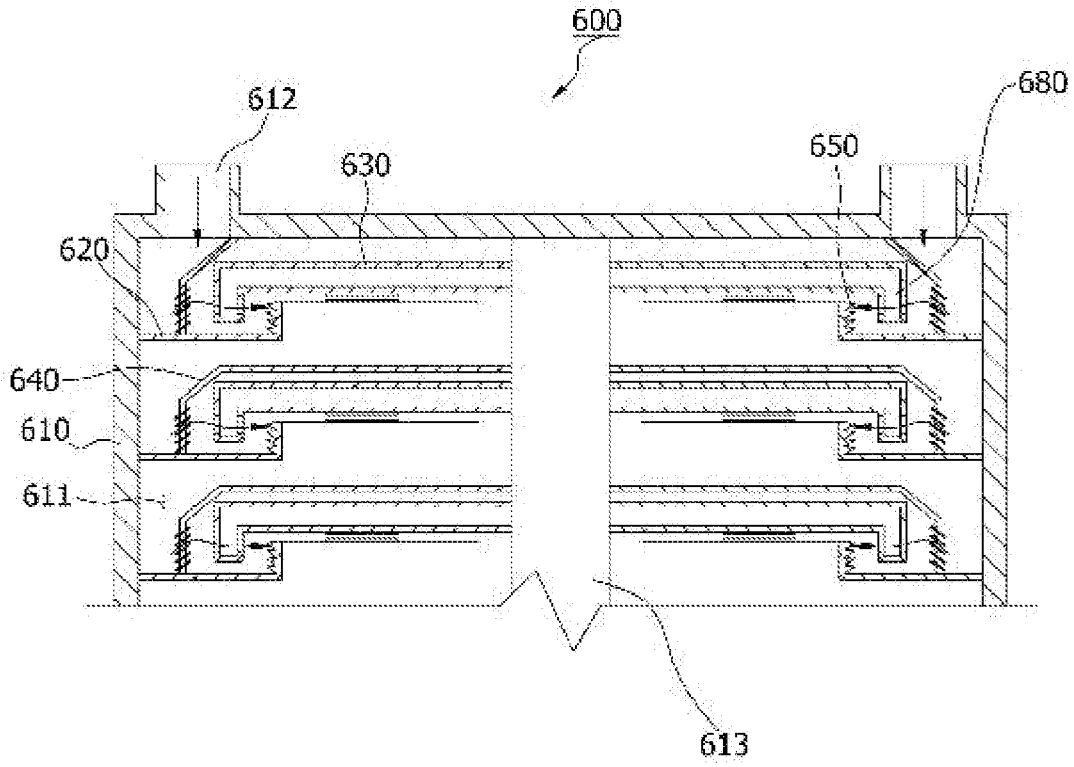
[Fig.13]

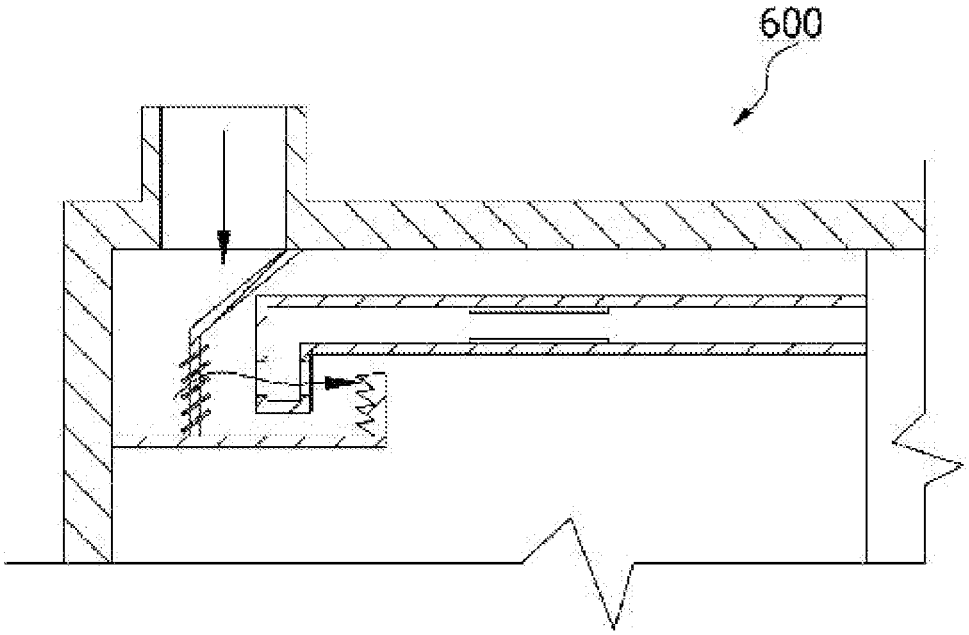
[Fig.14]

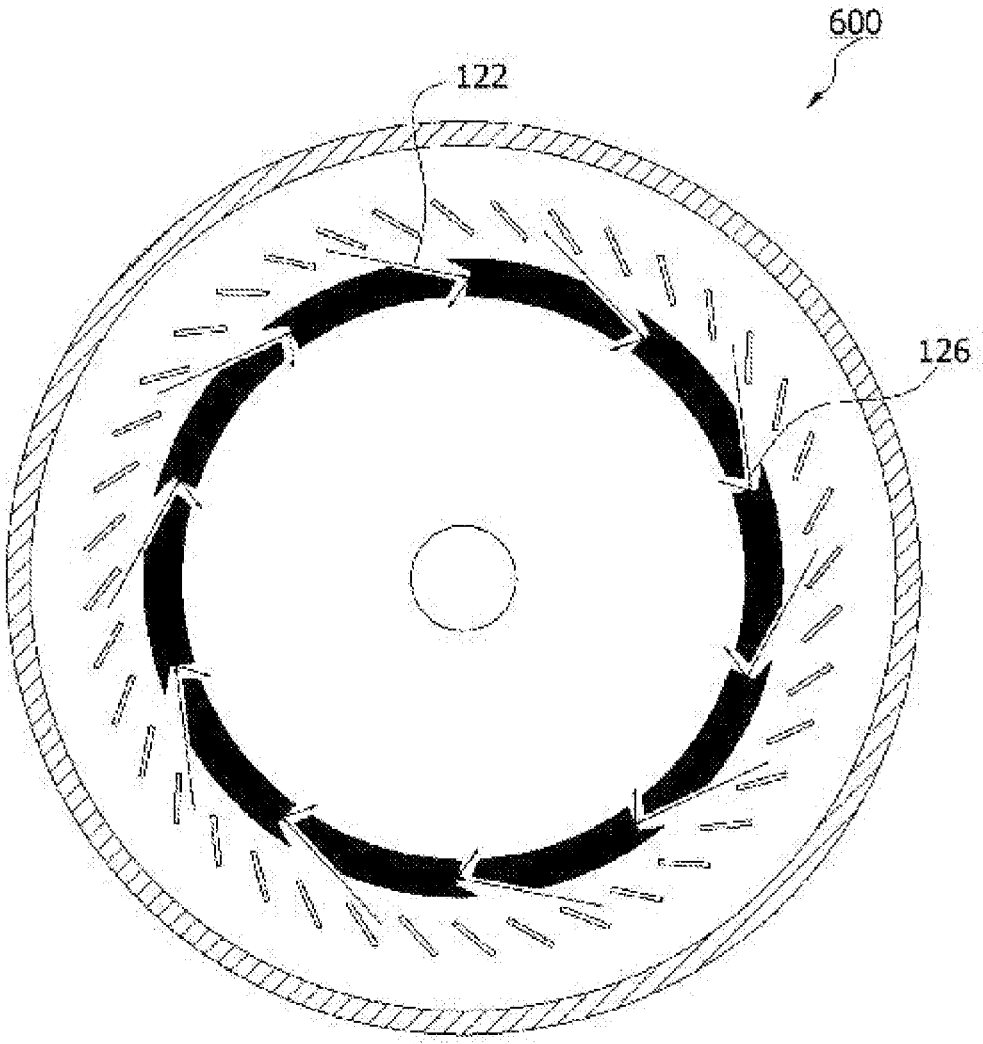
[Fig.15a]

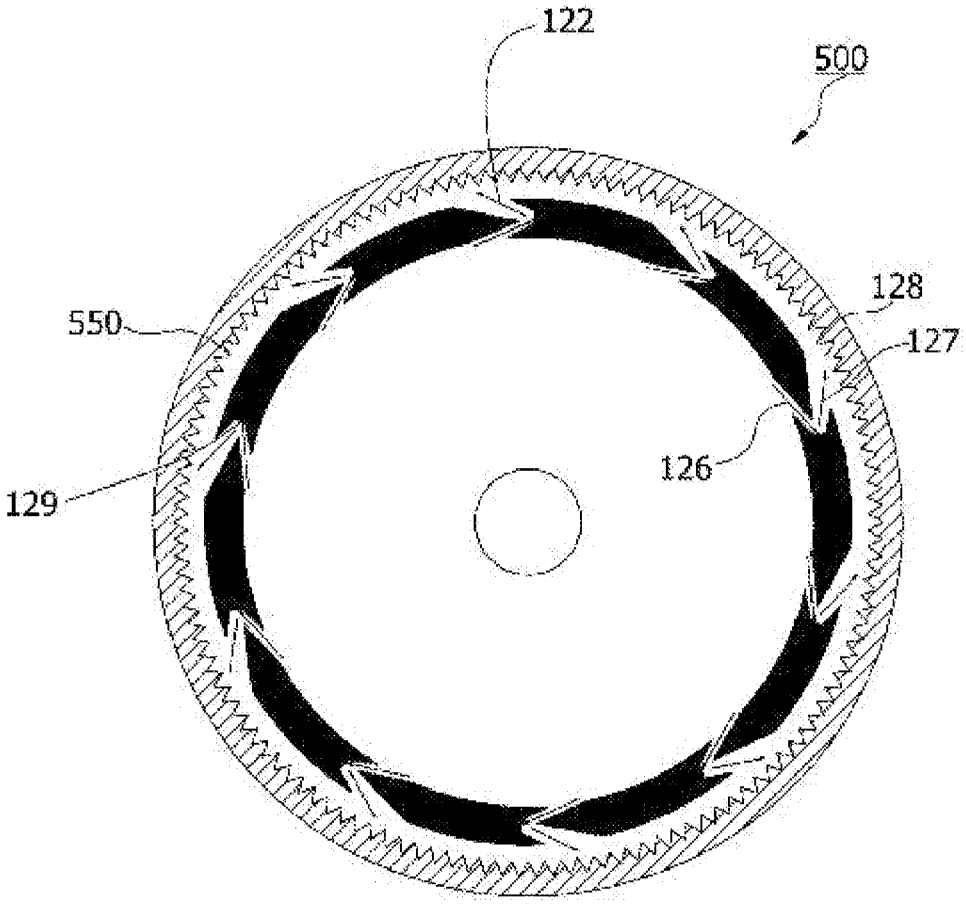
[Fig.15b]

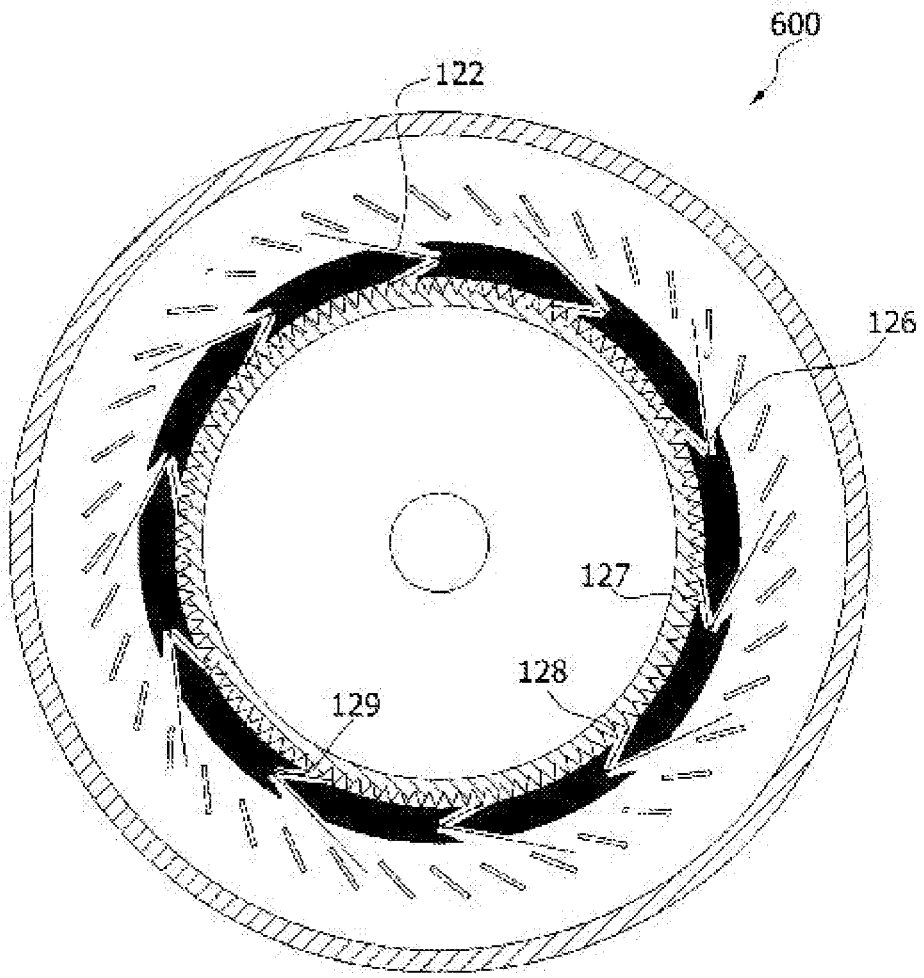
[Fig.16]

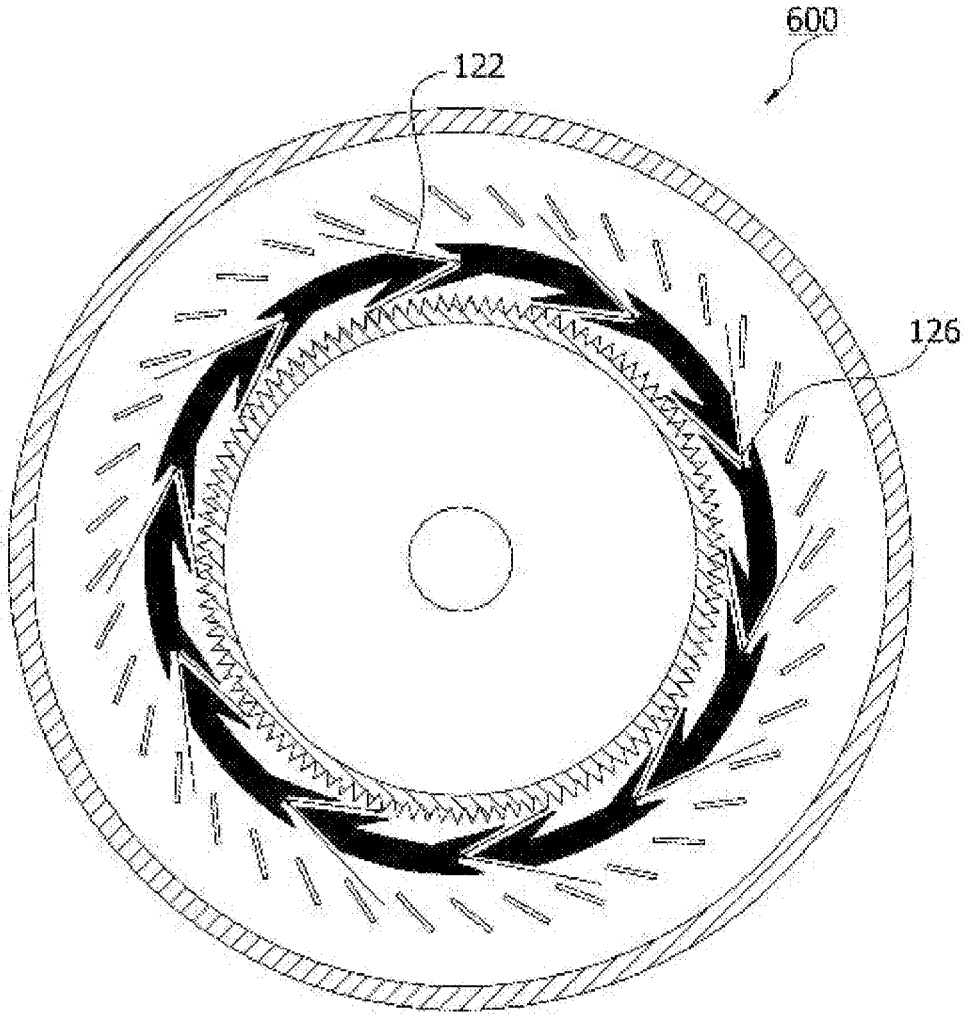
[Fig.17]

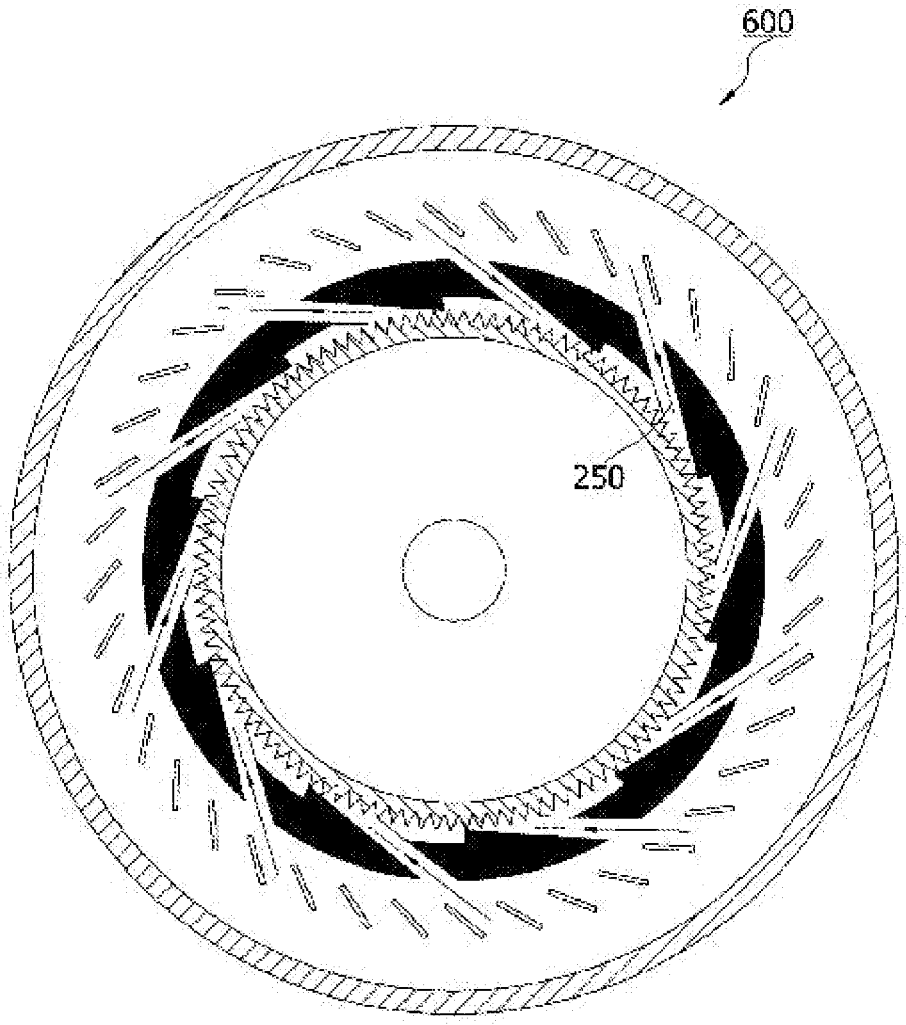
[Fig.18]

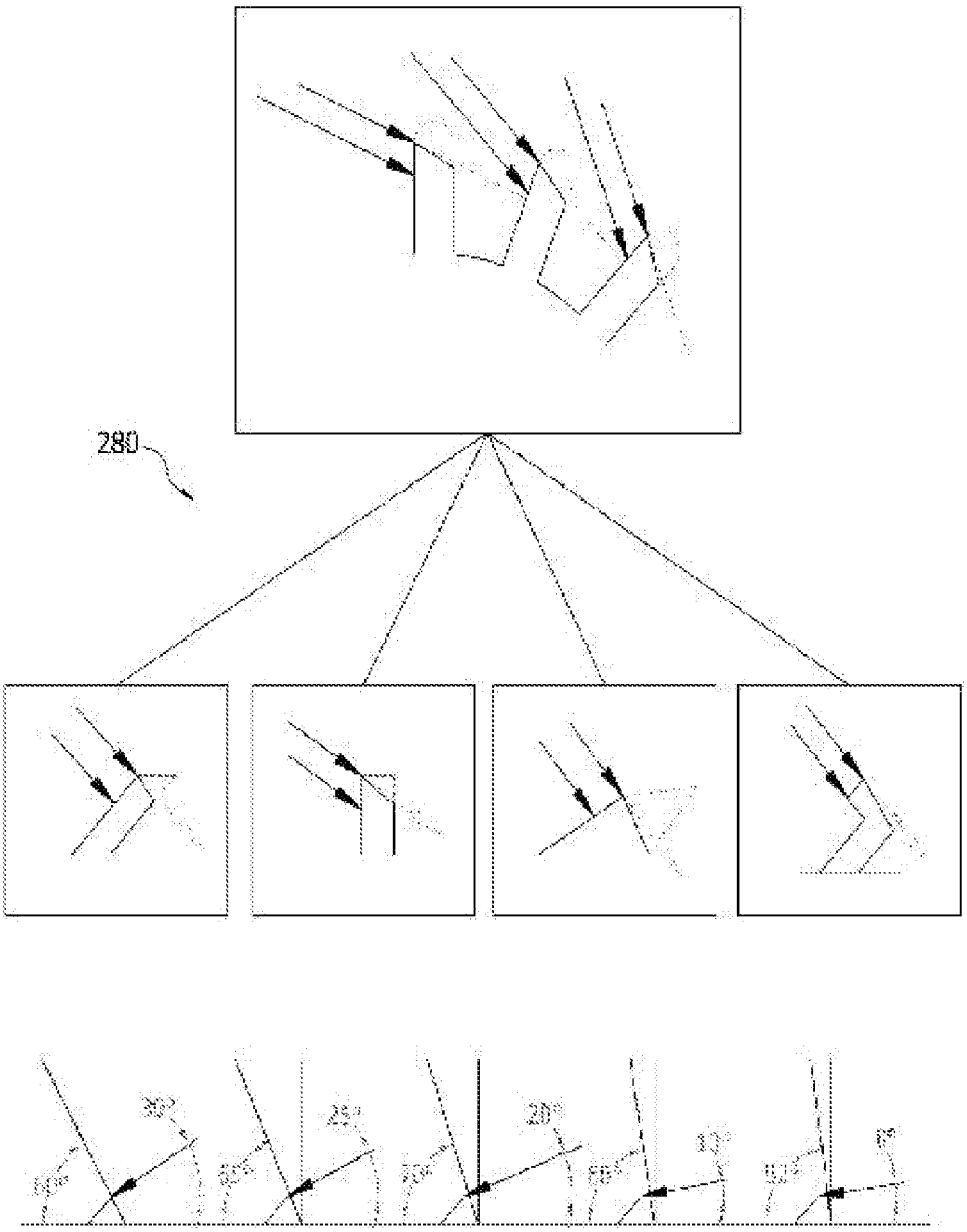
[Fig.19]

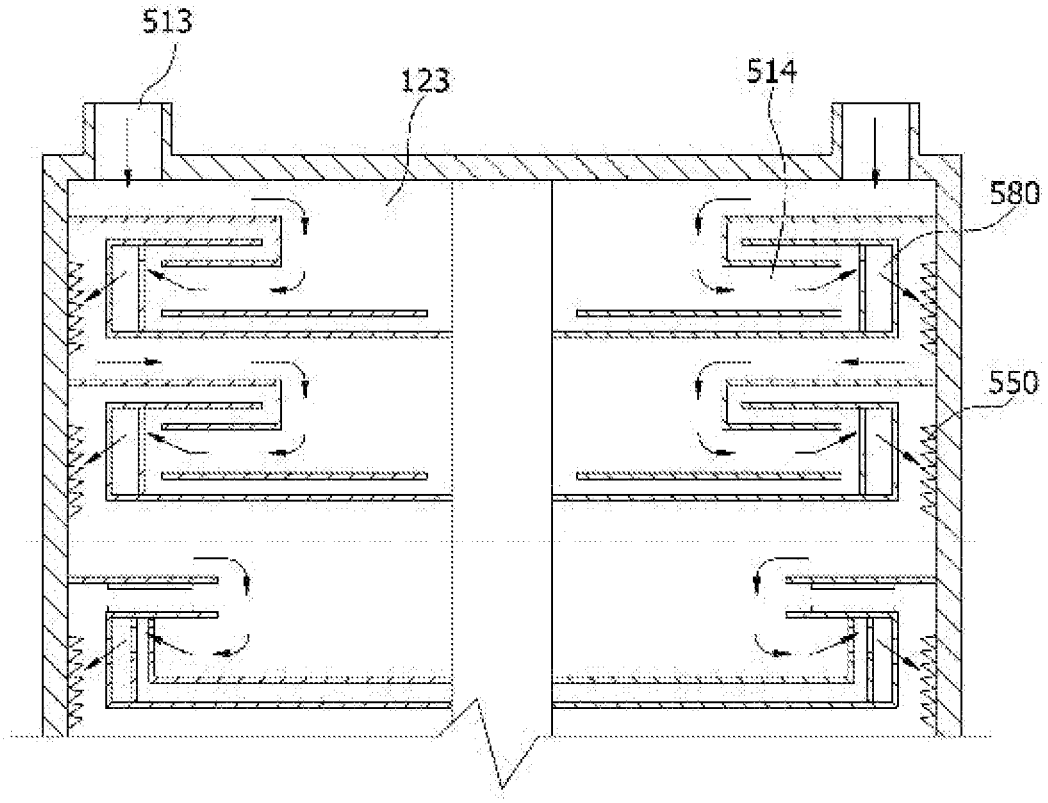
[Fig.20]

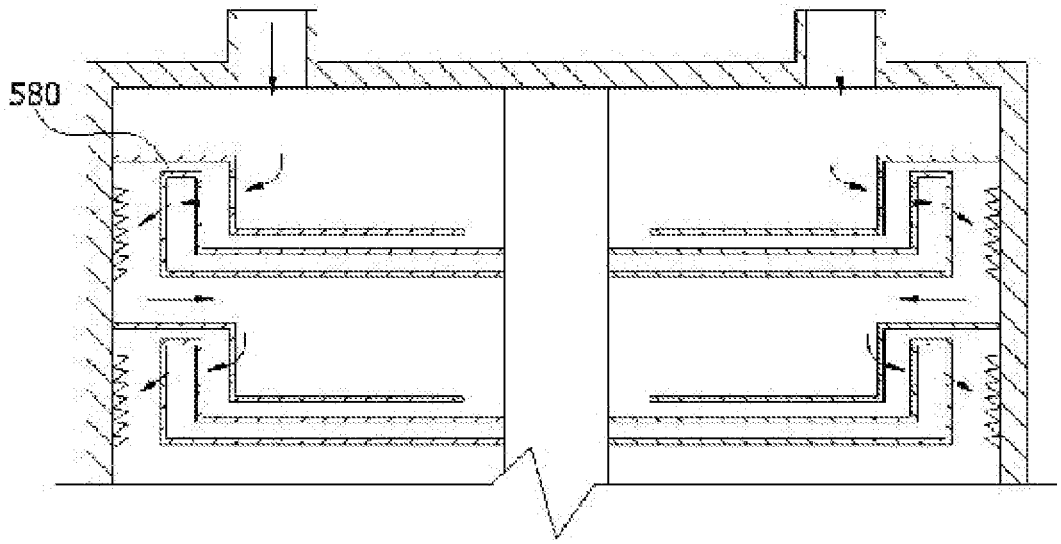
[Fig.21]

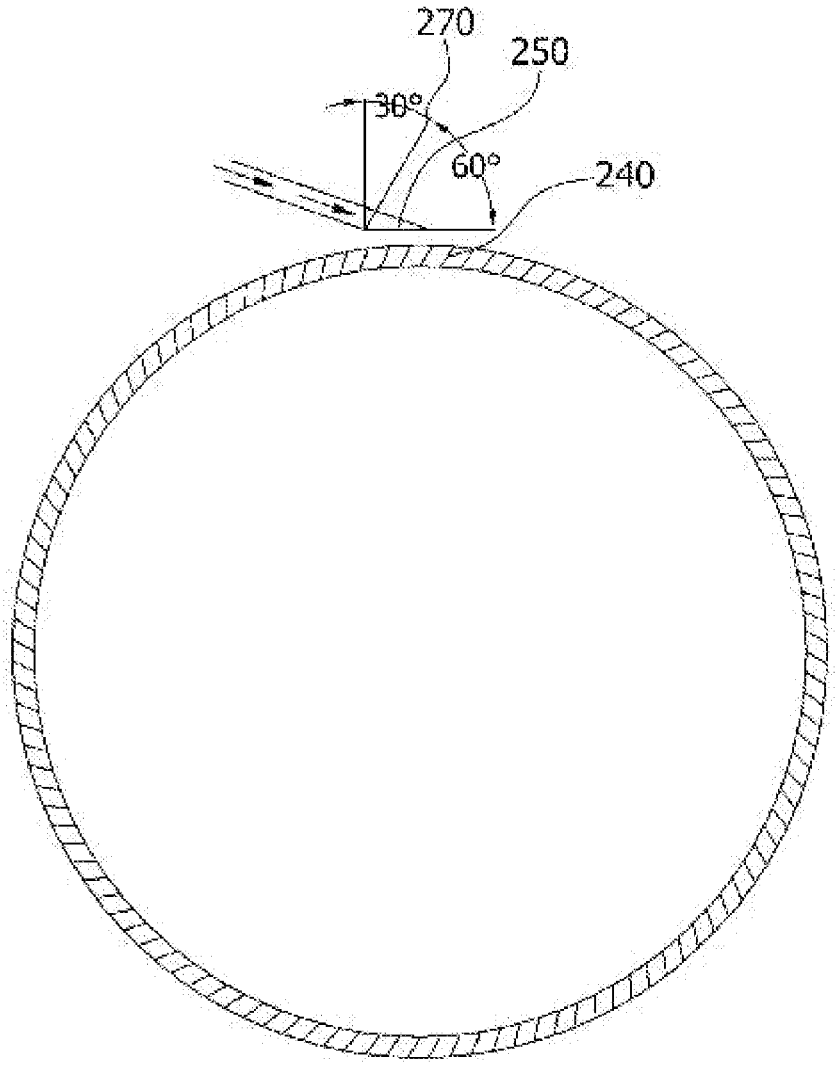
[Fig.22]

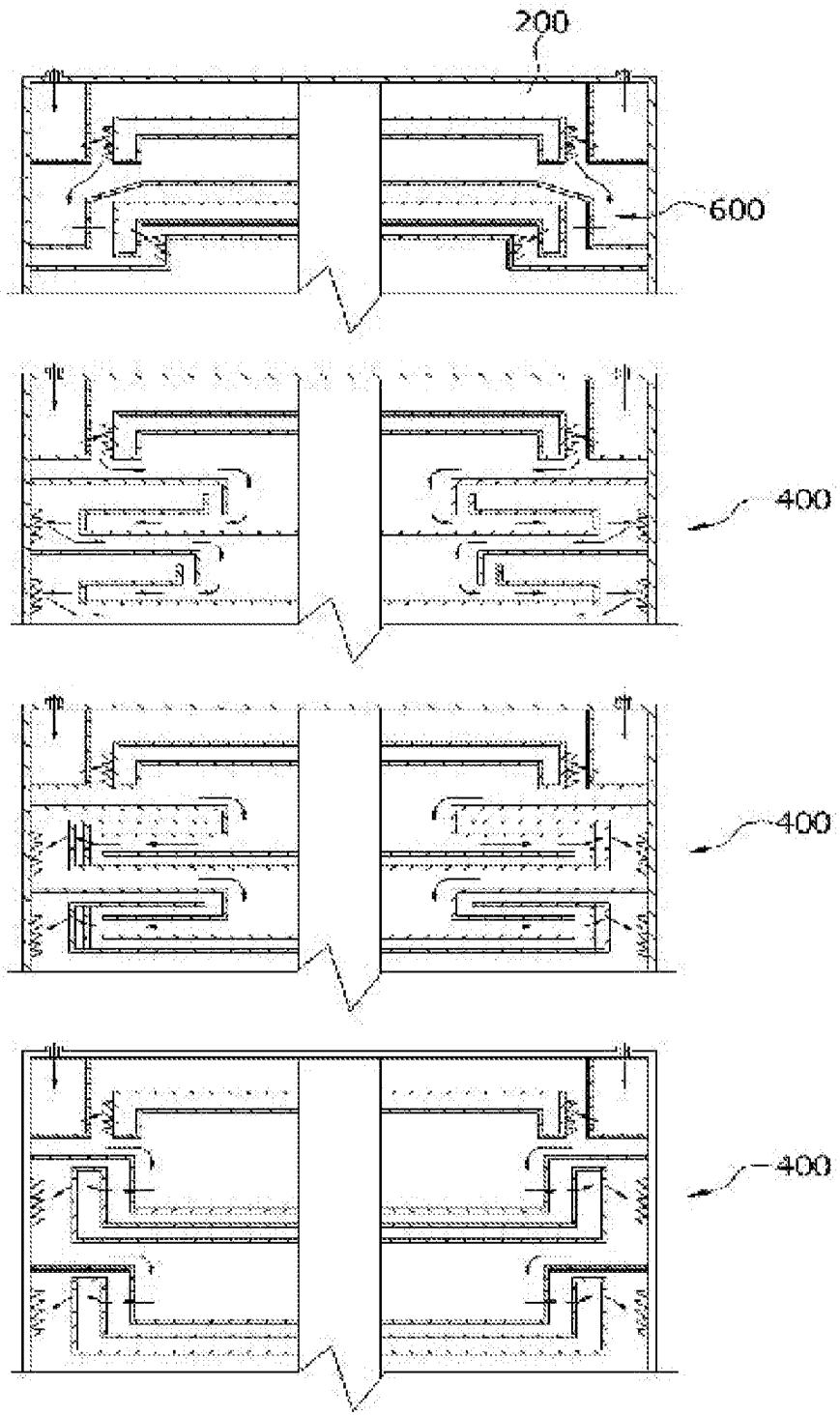
[Fig.23]

AXIAL TURBINE

TECHNICAL FIELD

The present invention relates to an improved structure of an axial turbine which can be arbitrarily formed in one stage or in multi-stages according to a type, a flow rate, or a head of a fluid, and more particularly to a submerged turbine, a colliding turbine, a repulsive turbine, or a combined turbine in which two of a submerged turbine, a colliding turbine, and a repulsive turbine are combined to be selectively used according to a field situation, by which quality and reliability of a product can be significantly improved to satisfy the operator.

In-use ranges: gas, steam, water power, wind power, tidal current, tidal power, various power engines

BACKGROUND ART

The present invention is an improvement of Korean Patent Application Publication No. 2010-0105103 (Korean Patent Application No. 2009-0023951) (entitled axial turbine) filed by the applicant.

As generally known in the art, a turbine is a machine for converting the energy of a fluid such as water, gas, and steam into mechanical work, and is characterized in that the turbine is rotated. Generally, a turbo machine in which several blades or wings are implanted on a circumference of a rotating body to be rotated at a high speed by ejected steam or gas is referred to as a turbine. A water power turbine drops water of a high head such that the water passes through a runner to convert the energy of the water into mechanical work, and a steam turbine ejects steam of a predetermined pressure from a nozzle such that the steam is applied to blades to use stream energy to rotate the blades. Turbines include an impulse turbine, a submerged propelling turbine, and a repulsive turbine, and a combined gas turbine in which the advantages thereof are combined. A gas turbine uses the energy of gas with a high temperature and a high pressure, and an air turbine uses energy of compressed air of a high pressure. All turbines are important as they provide industrial power. Steam turbines are used to drive a generator in nuclear power plants, and also thermal power plants, and wind power turbines are used to move a generator in water power plants.

Meanwhile, a multistage turbine refers to a turbine in which gas or steam is divided into several stages to be expanded, and several stages including a nozzle, a fixed blade, and a rotary blade are combined.

However, the gas turbine has a low thermal efficiency and a high lower consumption, and the structure of rotating bodies are complex and large-sized so that a wide axial space is necessary and the gas turbine cannot be easily installed.

[Patent Document]

In order to solve the above-mentioned problems, the applicant filed Korean Patent Application Publication No. 2010-0105103 (Korean Patent Application No. 2009-0023951) (entitled multistage axial turbine). That is, according to the related art, as shown in FIGS. 1A, 1B, and 1C, the axial turbine includes a housing 20 formed such that a fluid may flow therein, a rotary shaft 30 rotatably installed in the housing 20, a front impeller 40 installed in the rotary shaft 30 and having a plurality of through-holes 41 through which the fluid passes, and rear impellers 50 fixed to the rotary shaft 30 to be located at a rear side of the front impeller 40, for generating rotating power by guiding a flow of the fluid.

Constituent elements of the axial turbine configured as described above will be described as follows. The housing 20 includes a cylindrical body 22 opposite sides of which are opened such that a fluid that is a gas or a liquid may be introduced into the body 22, a front cover 21 having an inlet 24 through which the fluid is introduced into the housing 20 and covering a front side of the body 22, and a rear cover 23 covering a lower side of the body 22 and having a discharge hole 25 from which the fluid in the housing 20 is discharged.

The housing 20 configured as described above will be described in more detail as follows. The front cover 21 and the rear cover 23 have disk shapes having an outer diameter corresponding to an outer diameter of the housing 20. Through-holes 41 are formed at the centers of the front cover 21 and the rear cover 23 such that the rotary shaft 30 may be inserted into the through-holes 41. It is preferable that bearings 26 are installed in the through-holes of the front cover 21 and the rear cover 23 such that the rotary shaft 30 may be easily rotated. A plurality of through-holes are formed at peripheries of the front cover 21 and the rear cover 23 such that the front cover 21 and the rear cover 23 may be coupled to the housing 20 by bolts. The body 22 includes an accommodating space in which a front impeller 40 and a plurality of rear impellers 50 may be accommodated. An impeller fixing recess 27 to which the front impeller 40 may be fixed is formed on an inner peripheral surface of a front end of the body 22. The rotary shaft 30 has a rod shape, and opposite ends of the rotary shaft 30 are rotatably supported by the front cover 21 and the rear cover 23 covering opposite side surfaces of the housing 20. The front impeller 40 has a disk-shaped structure, and since a fluid of a high temperature and a high pressure may be introduced, it is preferable that the front impeller 40 is formed of a heat-resistant material. Although not shown, a periphery of the front impeller 40 is fixed to the impeller fixing recess 27 in the housing 20 by fixing bolts. A through-hole is formed at a central portion of the front impeller 40 such that the rotary shaft 30 is inserted into the through hole to be rotatably supported by the through-hole. It is preferable that bearings 26 are installed in the through-holes of the front cover 40 such that the rotary shaft 30 may be easily rotated. A plurality of through-holes 41 passing through the front impeller 40 inclinedly are formed in the front impeller 40 such that the fluid introduced into the housing 20 passes through the through-holes 41 to be guided into a guide groove 51 of the rear impeller 50.

The through-holes 41 of the above-mentioned front impeller 40 will be described in detail as follows. Each of the through-holes 41 of the front impeller 40 includes a vertical portion 42 vertically formed from a front side surface of the front impeller 40 to an interior of the front impeller 40, and a bending portion 43 communicated with the vertical portion 42 and bent to correspond to a location of the guide groove 51 of the front impeller 50. Although not shown, unlike the embodiments of the present invention, the vertical portion 42 and the bending portion 43 of the front impeller 40 are not divided but integrally formed to be inclined in a direction corresponding to a rotation direction of the rotary shaft 30.

Meanwhile, although it has been described that a row of through-holes 41 are formed along a circumferential direction of the front impeller 40, the number of the arranged through-holes 41 is not limited to the shown example but a plurality of rows of through-holes may be formed according to a flow rate and a pressure of the fluid.

However, the technology according to the related art also has the following problems. That is, since the turbine does not include a submerged turbine and a colliding turbine, it cannot be selectively used in correspondence to a field situation. Further, the technology according to the related art cannot maximize an angle efficiency of a turbine wing. In addition, the technology cannot prevent loss of flow rate. Furthermore, in the technology according to the related art, since a pressure of a fluid pushes down the wings, the wings may be damaged and distance efficiency cannot be maximized. In addition, the technology according to the related art cannot solve the problem of lowering a temperature of the fluid. Finally, the technology according to the related art fails to solve the problems of applying a load to a pressure of the wings.

DETAILED DESCRIPTION OF THE INVENTION

Technical Problem

Accordingly, the present invention has been made in an effort to solve the above-mentioned problems, and it is a first object of the present invention to a submerged turbine in which a fluid is filled therein, a colliding turbine for ejecting a high pressure fluid to rotate blades, and a repulsive turbine in which a fluid enters interiors of rotary blades, is ejected from peripheries of rotating bodies, and collides with fixed resistant bosses such that the rotating bodies are rotated by the collision forces. A second object of the present invention through the technical configuration lies in that the structure of the turbine is configured by combining a colliding turbine and a repulsive turbine to be selectively used in correspondence to a field situation. A third object of the present invention is to maximize an angle efficiency at which a fluid collides with blades of a turbine. A fourth object of the present invention is to prevent loss of flow rate. A fifth object of the present invention is to solve the problem of lowering temperature when a fluid is gas or steam. A sixth object of the present invention is to solve the problem of applying a load to a pressure of a wing. A seventh object of the present invention is to install introduction holes (ejection holes or nozzle holes) installed at a circumference of a bracket and introduction holes installed at circumferences of rotary blades such that the number of the introduction holes is determined according to a flow rate and a pressure (velocity) of a fluid. An eighth object of the present invention is to solve loads of vertical movements of rotary blades as compared with the case of applying a pressure to rotary blades according to the related art since the rotary blades are rotated by applying a pressure to ends of the rotary blades. A ninth object of the present invention is to provide an improved structure of an axial turbine by which a quality and a reliability of a product can be significantly improved and the operator can be provided with a satisfaction.

Technical Solution

In accordance with an aspect of the present invention, there is provided an improved axial turbine including: a submerged turbine in which a fluid is filled in an interior there, wherein the turbine includes: a body having a space filled with a fluid in an interior thereof and having an inlet and an outlet at one side and an opposite side thereof; a rotary shaft inserted into the center of the body and configured to be rotated; a plurality of rotary blades inserted into the body to be spaced apart from the rotary shaft by a predetermined separation and configured to be rotated; and a plurality of fixed blades fixedly installed between the rotary blades, each fixing blade having a plurality of through-holes and having a space in an interior thereof.

In accordance with another aspect of the present invention, there is provided an improved axial turbine including: a colliding turbine for rotating blades by ejecting a high pressure fluid, wherein the turbine includes: a body having an interior space and having an inlet and an outlet at one side and an opposite side thereof; a rotary shaft inserted into the center of the body and configured to be rotated; a plurality of rotary blades inserted into the body to be spaced apart from the rotary shaft by a predetermined separation and configured to be rotated; and a plurality of fixed blades fixedly installed in the body between the rotary blades to be spaced apart from the rotary blades, each of the fixed blades having an interior space in an interior thereof and having a plurality of nozzle holes at an outer side thereof.

In accordance with another aspect of the present invention, there is provided an improved axial turbine including: a turbine in which a submerged turbine and a colliding turbine are combined, wherein the turbine includes: a body having an interior space (and having an inlet and an outlet at one side and an opposite side thereof; a bracket installed in an interior of the body and having an ejection hole; a rotary shaft inserted into the center of the body and configured to be rotated; a first rotary blade and a first fixed blade mounted on the rotary shaft and having a colliding inclined surface such that a first stage is used in a colliding fashion; a plurality of second rotary blades mounted on the rotary shafts to be spaced apart from each other by a predetermined separation and configured to be rotated, each of the second rotary blades having an introduction hole and a space such that the turbine is used in a submerged propelling type from a second stage; and a plurality of fixed blades fixedly installed in the body to be spaced apart from each other by a predetermined separation, each of the second fixed blades having first, second, and third through.

In accordance with another aspect of the present invention, there is provided an improved axial turbine including: a submerged repulsive turbine in which a fluid enters a rotary blade through a discharge hole to be ejected from an interior of a wing, wherein the turbine includes: a body having an interior space filled with the fluid and having an inlet at an upper end thereof; a rotary shaft inserted into the center of the body and configured to be rotated; a plurality of rotary blades mounted on the rotary shaft to be spaced apart from each other by a predetermined separation and configured to be rotated; a plurality of fixed blades fixedly installed between the rotary blades within the body; and a plurality of resistant bosses protruding from an inner surface of the body to be spaced apart from each other by a predetermined separation.

In accordance with another aspect of the present invention, there is provided an improved axial turbine including: a submerged repulsive turbine in which a fluid enters a rotary blade through a discharge hole to be ejected from an interior of a wing, wherein the turbine includes: a body having an interior space filled with the fluid and having an inlet at an upper end thereof; a rotary shaft inserted into the center of the body and configured to be rotated; a plurality of rotary blades mounted on the rotary shaft to be spaced apart from each other by a predetermined separation and configured to be rotated; a plurality of fixed blades fixedly installed between the rotary blades within the body such that a length of the fixed blades becomes shorter and a height of the fixed blades becomes higher as the fixed blades go from upper ends to lower ends thereof; and a plurality of resistant bosses protruding from an inner surface of the body or between the body and the rotary blades to be spaced apart from each other by a predetermined separation.

In accordance with another aspect of the present invention, there is provided an improved axial turbine wherein in a repulsive type turbine, an end of a wing is bent upwards, a fluid proceeds from an inside to an outside of the wing through a pipe passage groove formed at the bending portion to collide with a wall formed at a front side of the groove, is ejected in a direction opposite to the rotation direction, and collides with resistant bosses formed in the ejection direction to obtain a repulsive force.

In accordance with another aspect of the present invention, there is provided an improved axial turbine including: a submerged propelling turbine for ejecting a high pressure fluid and rotating blades, wherein the turbine includes; a body having an interior space and an entry bracket and having a plurality of inlets; a rotary shaft inserted into the center of the body and configured to be rotated; a plurality of rotary blades mounted on the rotary shaft to be spaced apart from each other at a predetermined separation and configured to be rotated, in which ends of wings are bent downwards such that a fluid proceeds from an outside of the wings to an inside of the wings through pipe passage grooves, collides walls formed at front sides of the pipe passage grooves, collides with a plurality of resistant bosses while being ejected inwards or in a direction opposite to the rotation direction to obtain a repulsive force; and a plurality of fixed blades fixedly installed in the body between the rotary blades, each of the fixed blades having an interior space.

In accordance with another aspect of the present invention, there is provided a submerged propelling repulsive axial turbine, wherein a fluid enters an, enters a fixed space formed in an interior of a rotary blade through a discharge hole, enters a pipe passage groove formed at an end of a rotary body to collide a resistant wall formed on a front surface of the groove so as to perform a propelling operation, and the fluid collides a resistant boss wall formed at an inside of the housing to obtain a repulsive force while a direction of the fluid is changed to a direction opposite to the rotation direction such that the fluid is ejected.

Advantageous Effects

As discussed above in detail, the present invention includes a submerged turbine in which a fluid is filled in an interior thereof, a colliding turbine in which a high pressure fluid is ejected to rotate blades, and a repulsive turbine in which a fluid is ejected from interiors of rotary blades such that the fluid collides with resistant bosses to obtain a repulsive force.

An advantage of the present invention through the technical configuration lies in that the structure of the turbine is configured by combining a submerged turbine and a colliding turbine or a submerged turbine and a repulsive turbine to be selectively used in correspondence to a field situation.

Further, the present invention maximizes an angle efficiency of blades of a turbine.

Further, the present invention prevents loss of flow rate.

Further, the present invention maximizes distance efficiency.

Further, the present invention solves a problem of lowering a temperature of a fluid.

Further, the present invention is solves the problem of applying a load to a pressure of a wing.

The present invention is provides an improved structure of an axial turbine by which a quality and a reliability of a product can be significantly improved and the operator can be provided with a satisfaction.

Hereinafter, preferred embodiments of the present invention for achieving the effects will be described in detail with reference to the accompanying drawings.

BRIEF DESCRIPTION OF THE DRAWINGS

FIG. 1(*a*) is a sectional view showing an entire configuration of an axial turbine according to the related art;

FIG. 1(*b*) is a partial sectional view of the axial turbine according to the related art;

FIG. 1(*c*) is an exploded perspective view of the axial turbine according to the related art;

FIG. 2 is a sectional view of an axial turbine according to a first embodiment of the present invention;

FIG. 3 is a sectional view taken along line A-A of FIG. 2;

FIG. 4 is a sectional view taken along line B-B of FIG. 2;

FIG. 5 is a sectional view of an axial turbine according to a second embodiment of the present invention;

FIG. 6 is a sectional view taken along line C-C of FIG. 5;

FIG. 7 is a sectional view of an axial turbine according to a third embodiment of the present invention;

FIG. 8 is a sectional view of an axial turbine according to a fourth embodiment of the present invention;

FIG. 9 is a sectional view of an axial turbine according to a fifth embodiment of the present invention;

FIG. 10 is a sectional view of an axial turbine according to a sixth embodiment of the present invention;

FIG. 11 is a sectional view of an axial turbine according to a seventh embodiment of the present invention;

FIG. 12 is a top sectional view of FIG. 11;

FIG. 13 is a sectional view of an axial turbine according to an eighth embodiment of the present invention;

FIG. 14 is a sectional view of an axial turbine according to a ninth embodiment of the present invention;

FIGS. 15A and 15B are top sectional views of FIG. 13;

FIG. 16 is another top sectional view of FIG. 13;

FIG. 17 is another top sectional view of FIG. 13;

FIG. 18 is another top sectional view of FIG. 7;

FIG. 19 shows diagrams showing various embodiments of a resistance boss applied to the present invention; and FIGS. 20 to 23 are diagrams of other embodiments applied to the present invention.

DESCRIPTION OF REFERENCE NUMERALS

100, 200: turbine
110, 210: body
120, 230: rotary blade
130, 240: fixed blade
140: rotary magnet
141: fixed magnet
160, 260: rotary shaft

MODE FOR CARRYING OUT THE INVENTION

Improved structures of axial turbines applied to the present invention are configured as shown in FIGS. 2 to 23.

In a description of the present invention, a detailed description of related known functions and configurations will be omitted when it may make the essence of the present invention unnecessarily obscure.

Further, the following terms are terms set in consideration of their functions in the present invention and may become different according to intentions and customs of manufacturers, their definitions should be made based on the contents in the entire specification.

First, the present invention relates to an axial turbine, and includes a submerged turbine 100 in which a fluid is filled. The turbine includes a body 110 having a space 111 filled with a fluid in an interior thereof and having an inlet 112 and an outlet 113 at one side and an opposite side thereof; a rotary shaft 160 inserted into the center of the body 110 and configured to be rotated; a plurality of rotary blades 120 inserted into the body 110 to be spaced apart from the rotary shaft 160 by a predetermined separation and configured to be rotated; and a plurality of fixed blades 130 fixedly installed between the rotary blades 120, each fixing blade 130 having a plurality of through-holes and having a space 131 in an interior thereof.

Each of the rotary blades 120 has an interior space 121, an introduction hole 122 perpendicular to the inlet 112 is formed at an outer tip end of the rotary blade to prevent vertical movement of the rotary blade, a discharge hole 123 is formed at the center of the rotary blade 120 such that a fluid is discharged through the discharge hole 123, a resistant wall having various shapes such as a semicircle, a triangle, a tetragon, a diamond shape, and a polygon is formed at an outer side of the rotary blade 120 and pipe passage grooves 125 and 126 such that the fluid having passed through a pipe passage collides the resistant wall and is charged in a streamlined fashion, and the fluid proceeding through the pipe passage groove 125 and 126 collides with front walls 129 (FIG. 15B) of the pipe passage grooves and is discharged toward the center 123 of the rotary blade 120 while performing a propelling operation in a propelling (impulse) type.

Central apertures 151 are formed between the rotary blades 120 and the centers of the fixing blades 130 such that the fluid is discharged through the central aperture 151, side apertures 150 are formed between side surfaces of the rotary blades 120 and the fixed blades 130, and the fluid proceeds mainly between a rotary shaft 160 and an inside 123 of the fixed blades 130.

A rotary magnet 140 and a fixed magnet 141 are fixedly installed in the rotary blade 120 and the fixed blade 130 adjacent to the side aperture 150 to minimize a load of a blade pressure and increase a rotating force due to a mutual repulse while maintaining an interval between the rotary blade 120 and the fixed blade 130.

A thermal medium for preventing a temperature of the fluid from lowering is installed in the interior space 131 of the fixed blade 130.

Meanwhile, the axial turbine according to the present invention includes a colliding turbine 200 for ejecting a high pressure fluid and rotating the blades. The turbine includes a body 210 having an interior space 211 and having an inlet 212 and an outlet 213 at one side and an opposite side thereof; a rotary shaft 260 inserted into the center of the body 210 and configured to be rotated; a plurality of rotary blades 230 inserted into the body 210 to be spaced apart from the rotary shaft 260 by a predetermined separation and configured to be rotated; and a plurality of fixed blades 240 fixedly installed in the body 210 between the rotary blades 230 to be spaced apart from the rotary blades 230, each of the fixed blades 240 having an interior space 241 in an interior thereof and having a plurality of nozzle holes 242 at an outer side thereof.

A bracket 220 is fixedly installed to form the interior space 221 of the body 210 having the inlet 212, and the bracket has an ejection hole 222.

A plurality of variously modeled wings each having a colliding inclined surface 231 in the rotary blade 230 in a linear direction perpendicular to a progress direction of the fluid such that the fluid linearly collides the colliding inclined surface 231 in a direction in which the rotary blade 230 is rotated at a high speed while the fluid is ejected at a high speed through the ejection holes 222 and 242. An ejection angle of the fluid is 1 degrees to 30 degrees, and an inclination angle of the colliding inclined surface is 60 degrees to 90 degrees End surfaces 280 of the wings of the rotary blades has an angle that is equal to or less than an angle of the fluid ejected from a plate or below, and wherein an angle of a cross-section of the nozzle hole from which the fluid is ejected is parallel to a line of end surfaces 280 of the wings continuously formed from 60 degrees 270 (FIG. 22) or below.

A guide inclined surface 243 is further formed in the fixed blade 240 such that the fluid having collided with and popped from the colliding inclined surface 231 formed at an end of the rotary blade 230 enters the nozzle hole 242.

In addition, a thermal medium for preventing a temperature of the fluid from lowering is installed in the interior space 240 of the fixed blade 241.

Meanwhile, the axial turbine according to the present invention includes a turbine 300 such that a submerged turbine and a colliding turbine are combined. The turbine 300 includes; a body 310 having an interior space 311 and having an inlet 312 and an outlet 313 at one side and an opposite side thereof; a bracket 314 installed in an interior of the body 310 and having an ejection hole 315; a rotary shaft 360 inserted into the center of the body 310 and configured to be rotated; a first rotary blade 320 and a first fixed blade 330 mounted on the rotary shaft 360 and having a colliding inclined surface 321 such that a first stage is used in a colliding fashion; a plurality of second rotary blades 340 mounted on the rotary shafts 360 to be spaced apart from each other by a predetermined separation and configured to be rotated, each of the second rotary blades 340 having an introduction hole 342 and a space 341 such that the turbine is used in a submerged propelling type from a second stage; and a plurality of fixed blades 350 fixedly installed in the body 310 to be spaced apart from each other by a predetermined separation, each of the second fixed blades 350 having first, second, and third through-holes 351, 352, and 353.

Meanwhile, in an axial turbine according to the present invention, a submerged repulsive turbine 400 in which a fluid enters a rotary blade through a discharge hole 123 to be ejected from an interior of a wing, wherein the turbine includes; a body 410 having an interior space 411 filled with the fluid and having an inlet 413 at an upper end thereof; a rotary shaft 412 inserted into the center of the body 410 and configured to be rotated at a high speed; a plurality of rotary blades 420 mounted on the rotary shaft 412 to be spaced apart from each other by a predetermined separation and configured to be rotated; a plurality of fixed blades 430 fixedly installed between the rotary blades within the body 410; and a plurality of resistant bosses 415 protruding from an inner surface of the body 410 to be spaced apart from each other by a predetermined separation.

In an axial turbine according to the present invention, a submerged repulsive turbine 500 in which a fluid enters a rotary blade through a discharge hole 123 to be ejected from an interior of a wing, wherein the turbine includes; a body 511 having an interior space 513 filled with the fluid and having an inlet 510 at an upper end thereof; a rotary shaft 510 inserted into the center of the body 512 and configured to be rotated; a plurality of rotary blades 520 mounted on the rotary shaft 512 to be spaced apart from each other by a predetermined separation and configured to be rotated at a high speed; a plurality of fixed blades 530 fixedly installed between the rotary blades within the body 510 such that a length of the fixed blades becomes shorter and a height of the fixed blades becomes higher as the fixed blades go from upper ends to lower ends thereof; and a plurality of resistant bosses 515 protruding from an inner surface of the body 510 or between the body and the rotary blades to be spaced apart from each other by a predetermined separation.

Then, the resistant bosses 515 protrude from upper surfaces of the fixed blades 530, and the fluid is ejected from bottoms of the rotary blades.

A rotary blade 520 is mounted on an uppermost end of the rotary shaft 512; a connecting shaft 560 is inserted into a center upper end of the rotary blade 520 to be rotated; a central through-hole 561 is formed at the center of the connecting shaft 560 and a plurality of side through-holes 562 are formed on an outer peripheral surface of the connecting shaft 560 to be spaced apart from each other, the side through-holes being semicircular grooves; a housing 550 is installed at central upper end of the body 510 and on an outer peripheral surface of the connecting shaft 560; and an inlet 551 is formed at the center of the housing 550.

In a repulsive axial turbine according to the present invention, an end 580 of a wing is bent upwards, a fluid proceeds from an inside to an outside of the wing through a pipe passage groove 126 formed at the bending portion to collide with a wall 129 formed at a front side of the groove, is ejected in a direction opposite to the rotation direction, and collides with resistant bosses 515 formed in the ejection direction to obtain a repulsive force.

In an axial turbine according to the present invention, a submerged propelling turbine 600 for ejecting a high pressure fluid and rotating blades, wherein the turbine includes; a body 610 having an interior space 611 and an entry bracket 620 and having a plurality of inlets 612; a rotary shaft 613 inserted into the center of the body 610 and configured to be rotated; a plurality of rotary blades 630 mounted on the rotary shaft 613 to be spaced apart from each other at a predetermined separation and configured to be rotated, in which ends of wings are bent downwards such that a fluid proceeds from an outside of the wings to an inside of the wings through pipe passage grooves 126, collides walls 129 formed at front sides of the pipe passage grooves, collides with a plurality of resistant bosses 650 while being ejected inwards or in a direction 127 opposite to the rotation direction to obtain a repulsive force; and a plurality of fixed blades 640 fixedly installed in the body 610 between the rotary blades, each of the fixed blades 640 having an interior space.

Finally, in a submerged propelling repulsive axial turbine according to the present invention, a fluid enters an inlet 513, enters a fixed space 514 formed in an interior of a rotary blade through a discharge hole 123, enters a pipe passage groove 126 formed at an end 580 of the wing to collide a resistant wall 129 formed on a front surface of the pipe passage groove so as to perform a propelling operation, and the fluid collides a resistant boss wall 128 formed at an inside of the housing to obtain a repulsive force while a direction of the fluid is changed to a direction 127 opposite to the rotation direction such that the fluid is ejected.

Hereinafter, an operation and an effect of the present invention will be described below.

First, the first embodiment of the present invention is configured as shown in FIGS. 2, 3, and 4 or 15, 16, and 17, and a submerged turbine 100 is provided such that a fluid is filled in an interior of the turbine 100/

In more detail, a body 110 having a space 111 filled with a fluid in an interior thereof and having an inlet 112 and an outlet 113 at one side and an opposite side thereof is provided.

The rotary body 160 provided at the center of the body 110 is inserted into the body 110 to be rotated.

The rotary shaft 160 and the plurality of rotary blades 120 are rotated at a predetermined interval.

A plurality of fixed blades 130 fixedly installed between the rotary blades 120, each of the fixing blades 130 having a plurality of through-holes 132 and having a space 131 in an interior thereof are provided.

Meanwhile, an interior space 121 is formed in the rotary blade 120, a pipe passage groove 122 is formed at an outer tip end of the rotary blade in a direction perpendicular to the inlet 112 to prevent vertical movement of the rotary blade, a discharge hole 123 is formed at the center of the rotary blade 120 such that the fluid is discharged through the discharge hole 123, and various walls 125 having shapes such as a semicircle, a triangle, a tetragon, a diamond shape, and a polygon are provided at an outer side of the rotary blade 120 such that the fluid having passed through the pipe passage collides and is discharged in a streamlined fashion.

As shown in FIGS. 15, 16, and 17, a pipe passage groove 129 is formed in a direction perpendicular to an edge of the wing, and if the fluid entering through the pipe passage grooves 122 and 126 formed for guide of directions pushes the cut surface perpendicular to the cut surface linearly in the rotation direction, it collides the surfaces of the resistant bosses formed in the fixed blades while pushing the fixed blades to obtain a repulsive force.

In particular, the pipe passage grooves 122 and 126 act as pipe passages, and the pipe passages function to guide a direction of the fluid.

A central aperture 151 is formed between the rotary blade 120 and the center of the fixed blade 130 such that the fluid corresponding to a loss of flow rate is discharged, and a plurality of side apertures 150 are formed between side surfaces of the rotary blades 120 and the fixed blades 130 such that the fluid is discharged through the side apertures 150.

A rotary magnet 140 and a fixed magnet 141 are fixedly installed in the rotary blade 120 and the fixed blade 130 adjacent to the side aperture 150 to minimize a load of a blade pressure and increase a rotating force due to a mutual repulse while maintaining an interval between the rotary blade 120 and the fixed blade 130.

A thermal medium (for example; a heater or an ore) for preventing a temperature of the fluid from lowering is installed in the interior space 130 of the fixed blade 131 and provides a fluid travel path.

Hereinafter, an operation and an effect of the improved axial turbine according to the first embodiment of the present invention will be described.

First, the present invention is configured such that the structure of the turbine is submerged, and FIG. 2 is a sectional view of an axial turbine according to a first embodiment of the present invention, FIG. 3 is a sectional view taken along line A-A of FIG. 2, and FIG. 4 is a sectional view taken along line B-B of FIG. 2.

Thereto, according to the present invention, the fluid is fully filled in the interior space 111 through the inlet 112 while the outlet 113 of the body 110 is blocked.

Accordingly, a travel passage of the fluid is formed in the interior space 121 of the rotary blade 120 as well as in the interior space 111 of the body 110, and the size of the passage space is adjusted according to the type of the fluid or a pressure situation.

As shown in FIG. 2, if the fluid is injected through the inlet 112 at a high pressure in this state, the fluid is introduced into an interior of the interior space 121 through a plurality of pipe passage grooves 122 and rotates the rotary blades 120 about the rotary shaft 160 at a high speed.

As shown in FIG. 2, the fluid is discharged through the discharge hole 123, and passes through the side apertures 150, that is, between the dually formed fixed blades to be discharged to the following stage.

In addition, as shown in FIG. 2, the fluid travels even to the side apertures 150 and is discharged through the fixed blades in the next stage after being discharged to the central aperture 151, and according to the related art, a force by which the rotary blades 120 are rotated at a high speed while the fluid is discharged from the central shaft is increased to minimize loss of a flow rate instead of discharging a fluid between a bottom surface of the turbine blade and an inner wall of the housing.

When the rotary blades 120 are rotated, the adjacent fixed blades 130 remains fixed without being rotated.

In particular, since rotary magnets 140 are installed in the rotary blades 120 and the fixed blades 130 facing the side apertures 150, a load of a wing pressure is minimized when the rotary blades 120 are rotated about the fixed blades 130 such that the interval can be always constantly maintained even when the rotary blades 120 are rotated at a high speed and the rotary blades 120 are rotated at a high sped safely without being shaken vertically.

A thermal medium (for example, a heater or an ore) for preventing a temperature of the fluid from lowering is installed in the interior spaces 131 of the fixed blades 130 applied to the present invention, and this is because if a temperature of the fluid lowers, a pressure of the fluid also lowers to degrade a rotating force, so that a thermal medium for maintaining the temperature of the fluid is installed in the interior spaces 131 of the fixed blades 130.

The second embodiment of the present invention is configured as shown in FIGS. 5 and 6, and a colliding turbine 200 for ejecting a high pressure fluid to rotate blades is provided.

In more detail, a body 210 having a space 211 filled with a fluid in an interior thereof and having an inlet 212 and an outlet 213 at one side and an opposite side thereof is provided.

A rotary shaft 260 inserted into the center of the body 210 and configured to be rotated is provided.

A plurality of rotary blades 230 mounted on the rotary shaft 260 in integral multi-stages or to be space apart from each other at a predetermined separation are provided.

A plurality of fixed blades 240 fixedly installed in the body 210 and fixedly installed between the rotary blades 230 to be spaced apart from each other at a predetermined separation, each of the fixed blades 240 having an interior space 241 and having a plurality of nozzle holes 242 at an outer side thereof is provided.

Meanwhile, a bracket 220 is fixedly installed to form the interior space 221 of the body 210 having the inlet 212, and the bracket has an ejection hole 222 such that the ejection hole 222 is perpendicular to the rotary blades.

A plurality of colliding inclined surfaces 231 are formed in the rotary blades 230 in a direction inclined by 60 degrees to 90 degrees with respect to a travel direction of the fluid to be spaced apart from each other at a predetermined separation such that front sides of the colliding inclined surfaces 231 collides with the fluid to be rotated in the process of ejecting the fluid introduced through the ejection holes 222 and 242 at a high pressure. That is, the ejection angle of the fluid is 1 degrees to 30 degrees, the colliding inclined surfaces are inclined by an inclination angle of 60 degrees to 90 degrees, and the ejection angle is perpendicular to the angle of the colliding surfaces.

At a portion where the fluid is ejected to collide with the wing of the rotary blade as shown in FIG. 6, a bottom surface of the wing is formed from below a plane to an angle of the fluid ejected as in FIG. 19 or below.

A guide inclined surface 243 is formed in the fixed blade 240 such that the fluid having collided with and popped from the colliding inclined surface 231 formed at an end of the rotary blade 230 enters the nozzle hole 242.

A thermal medium (for example; a heater or an ore) for preventing a temperature of the fluid from lowering is installed in the interior space 240 of the fixed blade 241.

Hereinafter, an operation and an effect of the improved axial turbine according to the second embodiment of the present invention will be described.

First, the turbine according to the present invention has a colliding structure, and FIG. 5 is a sectional view of the improved axial turbine according to the second embodiment of the present invention and FIG. 6 is a sectional view taken along line C-C of FIG. 5.

Thereto, since the compressed fluid is ejected through an ejection hole while a fluid is filled in the interior space 211 of the body 210 if the fluid is injected through the inlet 212 of the body, the rotary blades 230 is rotated at a high speed.

In more detail, the fluid injected through the inlet 212 is injected into the interior space 221 of the bracket 220 and immediately passes through the outlet 222.

The fluid having passed through the ejection hole 220 pushes and rotates the rotary blades 230 with a high pressure force, in which case since the fluid collides directly with the colliding inclined surfaces 231 of the rotary blades 230, it further rotates the rotary blades 230 at a high speed.

The fluid having collided with the colliding inclined surfaces 231 enters the interior space 211 of the body 210 while popping up to the outside, in which case the fluid is softly introduced into the interior space 211 without being hindered by the guide inclined surfaces 243 of the fixed blades 240, and the fluid introduced into the interior space 211 passes through the nozzle holes 242 without causing an abrupt temperature resistance by a heating unit installed on a wall of the space and rotates the second rotary blade 230 while colliding the second rotary blade with a high pressure force.

Even in this case, as described above, the fluid rotates the rotary blades 230 at a high speed while colliding with the colliding inclined surface 231, and since a plurality of rotary blades 230 are sequentially installed to be spaced apart from each other by a predetermined separation, the rotary blades 230 convert the energy of the fluid into available mechanical work while being rotated.

As shown in FIG. 5, most of the fluid having collided with the colliding inclined surface 231 enters the interior space 211, the remaining fluid is introduced into the side apertures 251 between the rotary blades 230 and the fixed blades 240, is withdrawn through the central aperture 250, is introduced into the side apertures 251, and is circulated in direction of arrows.

As described above, as the fluid is circulated through the side apertures 251 and the central aperture 250, loss of flow rate may be prevented.

A thermal medium (for example, a heater or an ore) for preventing a temperature of the fluid from lowering is installed in the interior spaces 241 of the fixed blades 240 applied to the present invention, and this is because if a temperature of the fluid lowers, a pressure of the fluid also lowers to degrade a rotating force, so that a thermal medium for maintaining the temperature of the fluid is installed in the interior spaces 241 of the fixed blades 240.

The third embodiment of the present invention is configured as shown in FIG. 7, the turbine 30 is provided such that a submerged turbine and a colliding turbine may be combined. The turbine 300 is configured as follows.

That is, a body 310 having a space 311 filled with a fluid in an interior thereof and having an inlet 312 and an outlet 313 at one side and an opposite side thereof is provided.

A bracket 314 installed in an interior of the body 310 and having an ejection hole 315 is provided.

A rotary shaft 360 inserted into the center of the body 310 and configured to be rotated is provided.

A first rotary blade 320 mounted on the rotary shaft 360 and having a colliding inclined surface 321 such that a first stage is used in a colliding fashion, and a first fixed blade 330 having an interior space 331 are provided.

In addition, a plurality of second rotary blades 340 mounted on the rotary shaft 360 to be spaced apart from each other by a predetermined separation and configured to be rotated, each of the second rotary blades 340 having an introduction hole 342 used in a submerged type turbine from a second stage and having an interior space 341 are provided.

Finally, a plurality of fixed blades 350 fixedly installed in the body 310 to be spaced part from each other by a predetermined separation, each of the fixed blades 350 having first, second, and third through-holes 351, 352, and 353 are provided.

A description of the remaining technical configurations is the same as those of the first and second embodiments.

Hereinafter, an operation and an effect of the improved axial turbine according to the third embodiment of the present invention will be described.

First, the turbine of the present invention has a structure in which a submerged turbine and a colliding turbine are combined, and FIG. 7 is a sectional view of the third embodiment.

The third embodiment of the present invention has the same operational effect as those of the submerged turbine and the colliding turbine, and in particular, since a thermal medium is installed in the second through-hole 352 in a process of discharging a fluid through the first, second, and third through-holes 351, 352, and 353 of the second fixed blade 350, lowering of temperature is prevented.

Although a first stage corresponds to a colliding turbine and a second stage corresponds to a submerged turbine according to the present invention, it will be appreciated that the first stage and the second stage may be exchanged.

Although a colliding turbine and a repulsive turbine may be combined or a repulsive turbine and a submerged turbine may be combined, they may be various combined according to a field situation.

The fourth embodiment of the present invention is configured as shown in FIG. 8, and in an axial turbine according to the present invention, a submerged repulsive turbine 400 in which a fluid enters a rotary blade through a discharge hole 123 to be ejected from an interior of a wing, wherein the turbine includes; a body 410 having an interior space 411 filled with the fluid and having an inlet 413 at an upper end thereof; a rotary shaft 412 inserted into the center of the body 410 and configured to be rotated at a high speed; a plurality of rotary blades 420 mounted on the rotary shaft 412 to be spaced apart from each other by a predetermined separation and configured to be rotated at a high speed; a plurality of fixed blades 430 fixedly installed between the rotary blades within the body 410; and a plurality of resistant bosses 415 protruding from an inner surface of the body 410 to be spaced apart from each other by a predetermined separation.

The fourth embodiment of the present invention corresponds to a submerged repulsive turbine, and is configured such that a fluid passes through an interior of the body of the fixed blade 430 to enter the interiors of the rotary blades 420 or passes between the rotary blades 420 and the fixed blade 430 to enter the interiors of the rotors. In particular, the fluid having entered the bodies of the rotary blades 420 is ejected toward surfaces of the resistant bosses 415 protruding from an inside of the body 410 at ends of the rotary blades 420 to obtain a repulsive force.

The fifth embodiment of the present invention is configured as shown in FIG. 9, and a submerged repulsive turbine 500 in which a fluid enters a rotary blade through a discharge hole to be ejected from an interior of a wing, wherein the turbine includes; a body 511 having an interior space 513 filled with the fluid and having an inlet 510 at an upper end thereof; a rotary shaft 510 inserted into the center of the body 512 and configured to be rotated; a plurality of rotary blades 520 mounted on the rotary shaft 512 to be spaced apart from each other by a predetermined separation and configured to be rotated; a plurality of fixed blades 530 fixedly installed between the rotary blades within the body 510 such that a length of the fixed blades becomes shorter and a height of the fixed blades becomes higher as the fixed blades go from upper ends to lower ends thereof; and a plurality of resistant bosses 515 protruding from an inner surface of the body 510 or between the body and the rotary blades to be spaced apart from each other by a predetermined separation The fifth embodiment of the present invention corresponds to a submerged repulsive turbine, and is configured such that a fluid enters the interiors of the rotary blades 520 or passes between the rotary blades 520 and the fixed blade 530 to enter the interiors of the rotors. In particular, the fluid having entered the bodies of the rotary blades 520 is ejected toward surfaces of the resistant bosses 515 protruding from an inside of the body 510 at ends of the rotary blades 520 to obtain a repulsive force. In particular, the fixed blades 530 guide a flow of the fluid since diameters of the fixed blades 530 becomes smaller as they go from upper ends to lower end of the fixed blades 530.

The sixth embodiment of the present invention is configured as shown in FIG. 10, and the resistant bosses 515 protrude from upper surfaces of the fixed blades 530.

The present invention aims to obtain a repulsive force when a liquid discharged through lower ends of the rotary blades 520 collides with the resistant bosses 515 protruding from upper ends of the fixed blades 530, and in particular, the fluid is ejected from bottom surfaces of the rotary blades.

The seventh embodiment of the present invention is configured as shown in FIG. 11, a rotary blade 520 is mounted on an uppermost end of the rotary shaft 512; a connecting shaft 560 is inserted into a center upper end of the rotary blade 520 to be rotated; a central through-hole 561 is formed at the center of the connecting shaft 560 and a plurality of side through-holes 562 are formed on an outer peripheral surface of the connecting shaft 560 to be spaced apart from each other, the side through-holes being semicircular grooves; a housing 550 is installed at central upper end of the body 510 and on an outer peripheral surface of the connecting shaft 560; and an inlet 551 is formed at the center of the housing 550.

According to the seventh embodiment of the present invention, if a fluid is introduced through a central injection hole 551 of the housing 550, the fluid is selectively introduced into the interiors of the rotary blades 520 through the central through-hole 561 or the side through-holes 562 of the connecting shaft 560, and the remaining technical operations and effects will be omitted since they are the same as those of FIG. 9.

The axial turbine according to the eighth embodiment of the present invention is configured as shown in FIG. 13, and includes a submerged propelling turbine 600 for rotating blades by ejecting a high pressure fluid. The turbine includes a body 610 having an interior space 611 and an entry bracket 620, the body having a plurality of inlets 612 at an upper end thereof; a rotary shaft 613 inserted into the center of the body 610 and configured to be rotated; a plurality of rotary blades 630 integrally installed in the rotary shaft 613 to be spaced apart from each other by a predetermined separation; and a plurality of fixed blades 640 fixedly installed in the body 610 and installed between the rotary blades, each of the fixed blades 640 having an interior space.

The eighth embodiment of the present invention is configured such that a fluid flows from an outer side to the center of the turbine, and the fluid introduced into the interior space 611 of the body 610 through the inlet 612 rotates the rotary blades 630 while passing through the bracket 620 and the fluid flows to a lower end of the turbine while passing between the rotary blades 630 and the fixed blades 640.

In particular, as shown in FIGS. 15 to 17, the present invention allows the fluid having passed through the rotary blades 630 to collide the bosses formed on outer surfaces of the fixed blades 640 to provide a propelling and repulsing effect.

FIG. 19 shows various forms of resistant bosses according to the present invention, and angles of the resistant bosses correspond to below 30 degrees to 8 degrees, and an angle of the fluid ejected for collision and repulsion is formed about a line in a direction in which the rotating bodies are rotated.

Meanwhile, the present invention may be variously modified in application of the constituent elements and may have various forms.

It will be appreciated that the present invention is not limited to the specific forms mentioned in the detailed description of the present invention, but includes all modifications, equivalents, and replacements without departing from the spirit defined by the claims claimed in the claims.

The invention claimed is:

1. An improved axial turbine for rotating blades by ejecting a fluid, the turbine comprising:

a body having an interior space and having an inlet at one side and an outlet at an opposite side thereof;

a rotary shaft inserted into a center of the body and configured to be rotated; a plurality of rotary blades connected to the rotary shaft to be spaced apart from one another by a predetermined separation and configured to be rotated; and a plurality of fixed blades fixedly installed in the body between the plurality of rotary blades to be spaced apart from the rotary blades, each of the fixed blades having an inner space in an interior thereof and having a plurality of nozzle holes at an outer side thereof, wherein each of the plurality of rotary blades comprises a plurality of wings each having a colliding inclined surface configured to be perpendicular to a progress direction of the fluid such that the fluid collides with the colliding inclined surface and the rotary blades are rotated while the fluid is ejected through an ejection hole and the plurality of nozzle holes and each wing of the plurality of wings has an end surface disposed at an angle to the colliding inclined surface, and wherein an ejection angle of the fluid is 1 degrees to 30 degrees and an inclination angle of the colliding inclined surface is 60 degrees to 90 degrees with respect to the progress direction of the fluid such that the ejection angle is perpendicular to the inclination angle, and the angle of each end surface of each of the wings of the rotary blades is equal to or less than the ejection angle of the fluid.

2. The improved axial turbine of claim 1, wherein a bracket is fixedly installed to form an entry space of the body having the inlet, and the bracket has the ejection hole.

3. The improved axial turbine of claim 1, wherein a guide inclined surface is disposed in each of the plurality of fixed blades such that the fluid having collided with and popped from the colliding inclined surface enters a respective nozzle hole of the plurality of nozzle holes.

4. The improved axial turbine of claim 1, wherein a thermal medium for maintaining a temperature of the fluid is provided in the inner space of one or more of the plurality of fixed blades.

* * * * *